US005349807A

United States Patent [19]

Kawarabashi et al.

[11] Patent Number: 5,349,807

[45] Date of Patent: Sep. 27, 1994

[54] ROBOT APPARATUS FOR DOUBLE TWISTER

[75] Inventors: Tsukasa Kawarabashi, Kyoto; Hiroshi Mima, Joyo; Tadashi Suzuki, Uji, all of Japan

[73] Assignee: Murata Kikai Kabushiki Kaisha, Kyoto, Japan

[21] Appl. No.: 870,550

[22] Filed: Apr. 17, 1992

[30] Foreign Application Priority Data

Apr. 19, 1991 [JP] Japan ..... 3-088455
Jun. 24, 1991 [JP] Japan ..... 3-180363
Jul. 1, 1991 [JP] Japan ..... 3-160632

[51] Int. Cl.[5] ..... D01H 11/00
[52] U.S. Cl. ..... 57/261; 57/270
[58] Field of Search ..... 57/266, 268, 220, 271, 57/272, 274, 275, 58.52, 261, 269, 270, 276, 278, 279, 264, 281, 58.83, 58.83, 58.86, 304

[56] References Cited

U.S. PATENT DOCUMENTS 2,650,779 9/1953 Uhlig ..... 57/58.86
4,107,910 8/1978 Fürstenberg et al. ..... 57/58.49
4,386,495 6/1983 Rothmeier et al. ..... 57/279
4,671,054 6/1987 Grundmann et al. ..... 57/58.49
4,928,476 5/1990 Otoshima et al. ..... 57/268
5,148,664 9/1992 Suzuki ..... 57/279 X
5,182,902 2/1993 Mima et al. ..... 57/279
5,184,453 2/1993 Mima et al. ..... 57/264 X
5,189,872 3/1993 Mima et al. ..... 57/264

*Primary Examiner*—Clifford D. Crowder
*Assistant Examiner*—Larry D. Worrell, Sr.

[57] ABSTRACT

A robot apparatus for a double twister, which can travel along the units of the double twister, is provided with an operating arm for drawing a yarn end from a feed package, a suction arm for drawing a yarn end from a winding package, a yarn hook portion for hooking both the drawn yarn ends, and a piecing device for piecing both the yarn ends at the hook portion. The robot apparatus is operated to enable formation of a full winding package having a predetermined winding amount from a plurality of feed packages without requiring a yarn length counter.

13 Claims, 18 Drawing Sheets

ROBOT APPARATUS FOR DOUBLE TWISTER

BACKGROUND OF THE INVENTION

1. Field of the Invention

The present invention relates to a robot apparatus which can travel along the units of a double twister and relates to a new method of operating a robot apparatus for a double twister which forms full winding packages from a plurality of predetermined length feed packages.

2. Prior Art

A double twister is a device in which a yarn drawn out of a feed package supported on a spindle is threaded through a center hole thereof, and wound about a core supported on a cradle while applying a twist to form a winding package. When the core winds thereabout all the yarn of the feed package into a full winding package, an empty feed package is replaced with a full feed package (replacement of yarn), a yarn end is drawn out of the feed package (yarn end finding), the yarn is threaded into the center hole (threading), the full winding package is removed from the cradle and supported on a new paper tube (doffing) and the yarn end drawn out of the feed package is fixed (hooking) to the paper tube.

In the past, these operations have been carried out exclusively by an operator, which takes much time.

However, nowadays, frequencies of operations such as doffing, yarn replacement and the like increase with small-volume production of various kinds of products, and automation of the aforesaid operations has been desired in an attempt of relieving labor and improving productivity.

A double twister is a device in which in each unit, a yarn is released from a feed package supported on a spindle to apply a twist thereto, and the resultant yarn is wound on a core supported on a cradle to form a full winding package.

This double twister requires package replacement in which an empty feed package is replaced with a new feed package, yarn end finding for pulling out a yarn end from the new feed package, threading for threading the pulled out yarn end into a spindle from an axial hole thereof, doffing for removing the full winding package from the cradle and supporting a new core on the cradle, and hanging for fixing the yarn end after being threaded into the core. A robot for automatically performing these operations has been developed (Japanese Patent Laid Open Publication No. 243470/1990).

A conventional double twister has a construction in which a feed package and a winding package correspond in the form of 1:1. Therefore, a spindle portion should have a large construction corresponding to the size of the feed package. It has been difficult to provide an implementation for multi-unit by miniaturization of units.

In order to solve this problem, winding packages having a predetermined size (winding amount) may be formed from a plurality of feed packages. In this case, there is a problem in that a yarn length counter need be provided on the double twister.

OBJECT AND SUMMARY OF THE INVENTION

It is an object of the present invention to provide a method of operating a robot for a double twister which can form full winding packages having a predetermined winding amount from a plurality of feed packages without requiring a yarn length counter.

For achieving the aforesaid object, the method according to the present invention comprises detecting a unit having a yarn breakage and detecting whether the unit having the yarn breakage has a winding package having a predetermined diameter and a yarn feed package having yarn remaining thereon. If a winding package having a predetermined diameter is detected and yarn remaining on the feed package is not detected, the yarn feed package is exchanged and the winding package is doffed. If a winding package having a predetermined diameter is not detected and yarn remaining on the feed package is not detected, then the yarn feed package is exchanged and the yarn end of the winding package and the yarn end of the feed package are pieced. If a winding package having a predetermined diameter is not detected and yarn remaining on the feed package is detected, then the yarn end of the winding package and the yarn end of the feed package are pieced.

According to the above-described structure, since the predetermined length feed package is used, whether or not the winding package of the unit with a yarn breakage has a predetermined diameter or and whether or not the feed package has a remaining yarn are merely detected whereby the robot carries out a predetermined operation according to the aforesaid mode to enable formation of a full winding package having a predetermined winding amount.

Accordingly, a winding package having a predetermined winding amount can be formed from a plurality of feed packages without requiring a yarn length counter. A unit can be miniaturized, and a multi-unit can be implemented.

It is another object of the present invention to provide a robot for a double twister which can automatically perform piecing for a unit with a yarn breakage, while overcoming the above-described problem.

It is still another object of the present invention to provide a robot provided with means for carrying out threading of a feed package supported on a spindle of a double twister.

For achieving the aforesaid object, according to the present invention, a robot body provided so that the robot can travel along the unit of the double twister is provided with an operating arm for drawing a yarn end from a feed package, a suction arm for drawing a yarn end from a winding package, a yarn hook portion for hooking both the drawn yarn ends, and a piecing device for piecing both the yarn ends at said hook portion.

When the robot body stops at a position of the unit with a yarn breakage, the operating arm draws the yarn end out of the feed package, the suction arm draws the yarn end out of the winding package and both the yarn ends are hooked on the yarn hook portion. Then, the piecing device is actuated to piece both the yarn ends being positioned at the yarn hook portion.

The operating arm may be provided with a device for removing a ball member mounted on an upper end of a top cap of a feed package during threading.

DETAILED DESCRIPTION OF PREFERRED EMBODIMENTS

One embodiment of the present invention will be described hereinbelow in detail with reference to the accompanying drawings.

Figure 1:
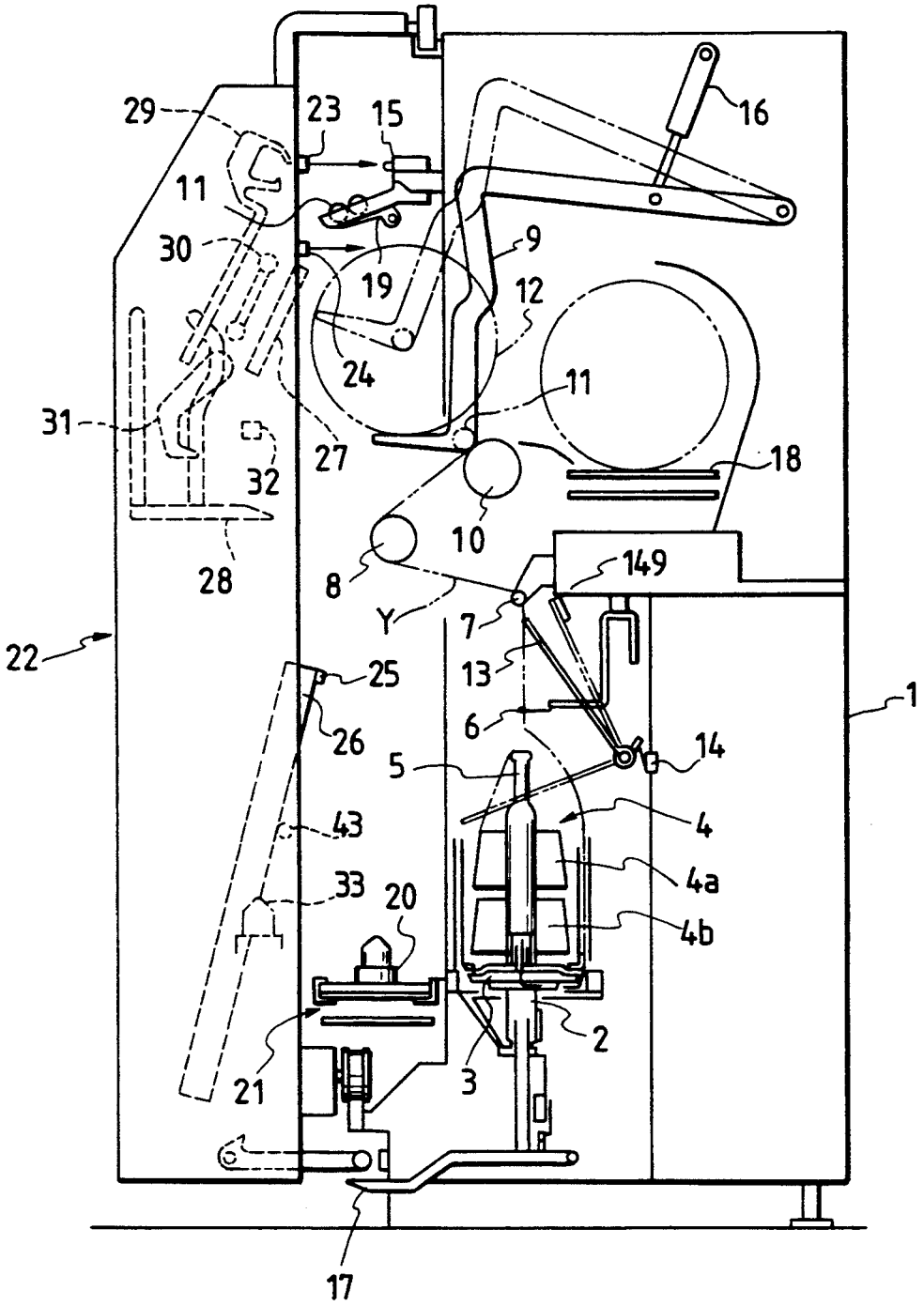
FIG. 1 is a sectional view showing a double twister and a robot applied to the present invention.

In FIG. 1, reference numeral 1 designates a unit of a double twister. A spindle 2 is vertically provided below each unit 1, and a feed package 4 is supported on the spindle 2 through a stationary board 3. This feed package 4 may be a doubled single package but in the embodiment, a two-stage feed package is used in which two packages 4a and 4b not doubled are stacked in a two-stage manner through an adapter 5. The packages 4a and 4b of the feed package 4 used are formed into predetermined length by an automatic winder.

A yarn Y released from the upper and lower packages 4a and 4b is introduced into an axial hole from the upper end of the adapter 5, passes through an axial hole and a radial hole not shown formed in the spindle 2, is doubled and twisted. The yarn is then discharged in a radial direction. The twisted yarn Y is upwardly guided while forming a balloon relative to an upper snail wire 6, is supported on a cradle 9 via a guide roller 7 and a feed roller 8, and is wound on a core 11 which rotates in contact with a rotational drum 10 to form a winding package 12.

A drop wire 13 is set against the yarn Y between the snail wire 6 and the guide roller 7. When a yarn breakage occurs, the drop wire 13 falls to turn a switch 14 ON whereby a display lamp 15 at the upper portion of the unit 1 is lighted, and the cradle 19 is raised to a doffing position by a cylinder 16.

When an operating pedal indicated at 17 is shallowly stepped, the spindle 2 stops, and when deeply stepped, threading compressed air is jetted into the radial hole to suck the interior of the axial hole. Reference numeral 18 designates a conveyor for moving out the doffed winding package 12, and reference numeral 19 designates a stocker storing therein the core 11.

A conveyor 21 for carrying the feed package 4 placed on a tray 20 along the unit 1 is provided in front of the unit 1 constructed as described above, and a robot 22 for performing yarn replacement is provided so as to freely travel along the unit 1. This robot 22 is provided with a sensor 23 for detecting the lighted display lamp 15, a sensor 24 for detecting whether or not the winding package 12 at a doffing position has a predetermined diameter, and a sensor 25 for detecting whether or not the feed package 4 has a remaining yarn, these sensors being formed from photosensors or the like.

Figure 2:
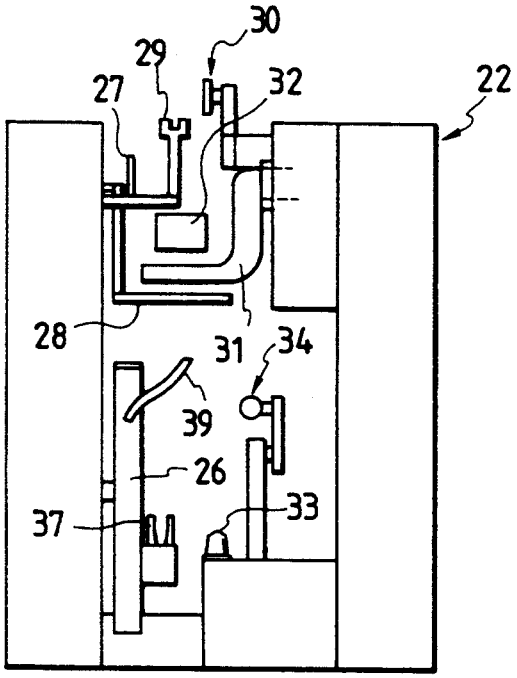
FIG. 2 is a front view of the robot.

The robot 22 has a U-shape in front as shown in FIG. 2, and on one side wall thereof are provided an operating arm 26 for performing replacement of yarn or the like, a cradle lever 27 for opening the cradle 9 at a doffing position to remove the winding package 12, a chute 28 for rolling the winding package 12 removed from the cradle 9 onto the conveyor 18, and a chucker arm 29 for supplying the core 11 from the stocker 19 to the cradle 9. For an example of a similar operating arm and its use, reference is made to U.S. Pat. No. 5182902 incorporated herein by reference.

On the other side wall of the robot 22 are provided a driving roller 30 for reversely rotating the winding package 12 at a doffing position, a suction arm 31 for sucking and drawing the yarn end from the reversely rotating winding package 12, and a piecing device 32 for piecing the yarn end of the winding package 12 with the yarn end of the feed package 4. Reference numeral 33 designates a temporary place peg for temporarily placing a new feed package when a yarn is replaced, and reference numeral 34 designates a yarn end finding mechanism for sucking and releasing a yarn end from a new feed package on the temporary place peg 33.

Figure 3:
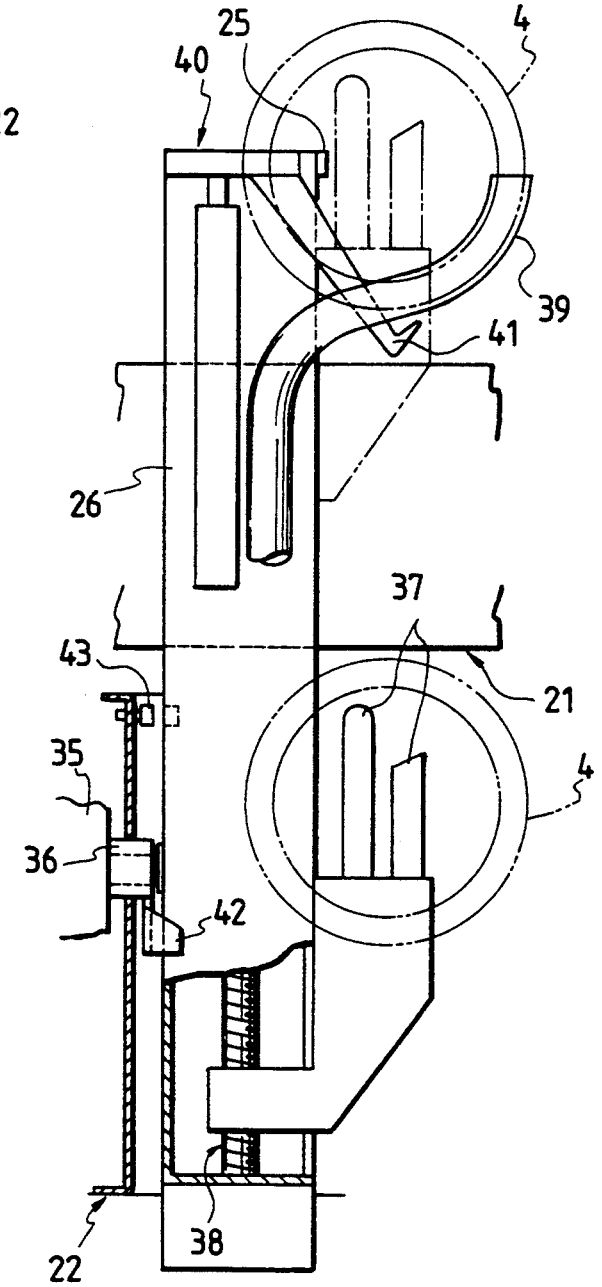
FIG. 3 is a plan view of an operating arm of the robot.

As shown in FIG. 3, the operating arm 26 is provided through a support shaft 36 on an elevating block 35 provided on one side wall of the robot 22 so that the arm 26 may be risen and fallen, and a chucker 37 for gripping an upper end of the adaptor 5 of the feed package 4 is longitudinally movably provided through a feed screw mechanism 38 on the side portion of the operating arm 26. On the extreme end of the operating arm 26 are provided the aforementioned remaining yarn sensor 25, a suction pipe 39 for sucking and holding a yarn end threaded and blown up, a pusher 40 for returning the drop wire 13 or the like, and a hook 41 provided on the pusher 40 to hook the yarn Y between the feed package 4 after threading and the suction pipe 39 on the snail wire 6 or the like. Reference numeral 42 designates a stopper for stopping the upper surface at the rear of the operating arm 26 to support it horizontally, and reference numeral 43 designates a stopper for stopping the lower surface at the extreme end of the horizontally moving down operating arm 26 to erect and store the operating arm 26 on the robot 22 side so as not to interfere with the unit during the travel.

Figure 5:
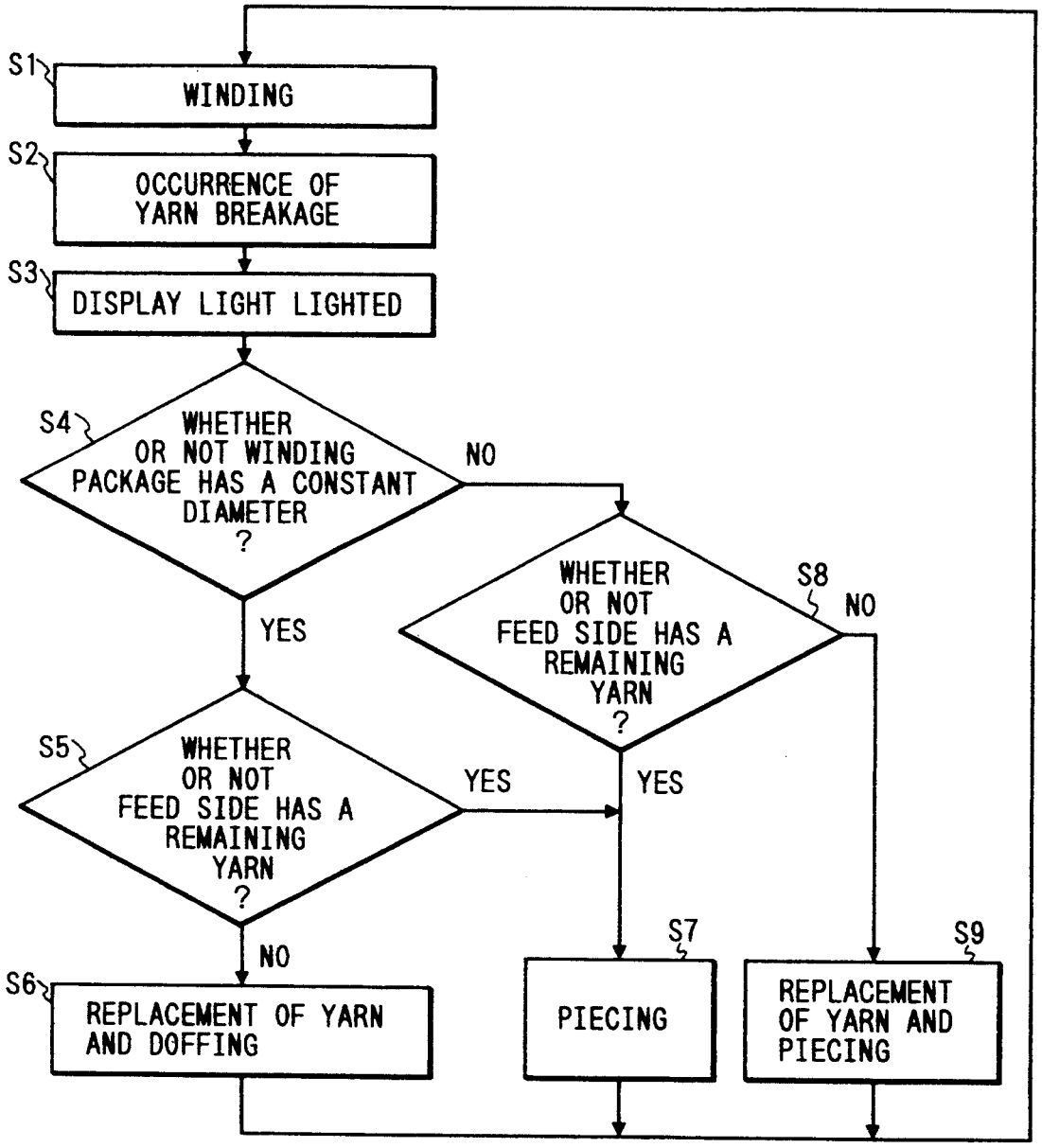
FIG. 5 is a flowchart showing the operating method for robot.
Figure 6:
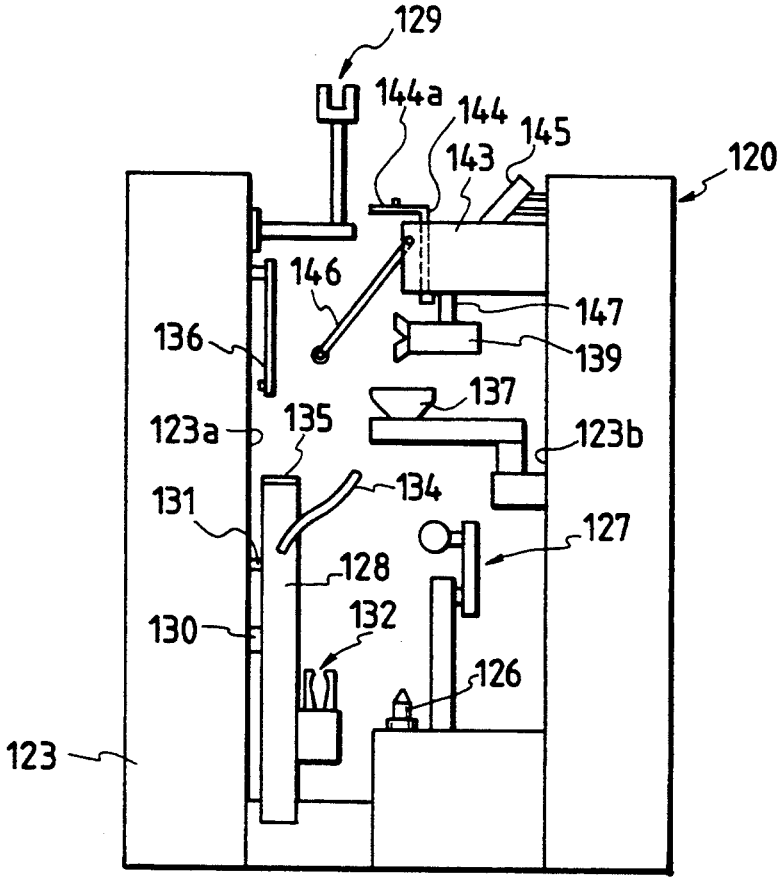
FIG. 6 is a front view of the robot.
Figure 7:
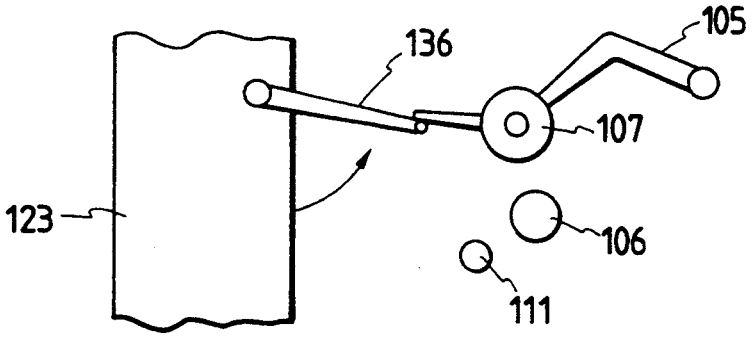
FIG. 7 is a view showing the operation of a package lifter.

The operating method for the robot 22 will be described hereinafter with reference to FIG. 5. When a yarn breakage occurs (S2) while the unit 1 is winding a yarn (S1), the drop wire 13 falls to turn the switch 14 ON, whereby the display lamp 15 is lighted (S3) and the winding package 12 is raised to a doffing position by the cylinder 16. This yarn breakage occurs in the case where the yarn Y of the feed package 4 is empty, and in the case where the twisted yarn Y is broken halfway.

When the display lamp 15 is detected by the sensor 23, the robot 22 which moves along the unit 1 stops at a position of the unit 1. First, whether or not the winding package 12 has a predetermined diameter is detected by the sensor 24, and the operating arm 26 is set to horizon so that whether or not the feed package 4 has a remaining yarn is detected by the sensor 25 at the extreme end thereof. More specifically, first, whether or not the winding package 12 has a predetermined diameter is detected (S4). In case of the predetermined diameter, whether or not the feed side has a remaining yarn is detected (S5). In case of no-remaining yarn, replacement of yarn and doffing are carried out (S6).

The aforementioned replacement of yarn is carried out by transferring a new feed package 4 from the tray 20 on the conveyor 21 onto the temporary place peg 33 by operation of the operating arm 26 and the chucker 37, transferring an empty feed package 4 from the spindle 2 to the tray 20, and thereafter transferring a new feed package 4 from the temporary place peg 33 onto the spindle 2. In this case, the yarn end finding of the new feed package 4 is carried out on the temporary place peg 33 by the yarn end finding mechanism 34. The threading of the new feed package 4 is carried out on the spindle 2.

The doffing is carried out by opening the cradle 9 by the cradle lever 27 to remove the winding package 12, rolling the winding package 12 on the conveyor 18 through the chute 28, and supplying the core 11 from the stocker 19 to the cradle 9 by the chucker arm 29. Upon termination of the doffing, the yarn end YA threaded and sucked and held by the suction pipe 39 of the operating arm 26 is hooked on the snail wire 6, the guide roller 7 and the core 11 of the cradle 9 by the hook 41. The winding starts (S1).

On the other hand, in case of the predetermined diameter and with a remaining yarn, actually the winding package 12 has no complete predetermined diameter in terms of precision of the sensor 24 for detecting a contour of the winding package 12, and the yarn Y is broken halfway. Therefore, the piecing is carried out (S7), and the winding starts so as to completely wind the remaining yarn of the feed package 4.

Figure 4:
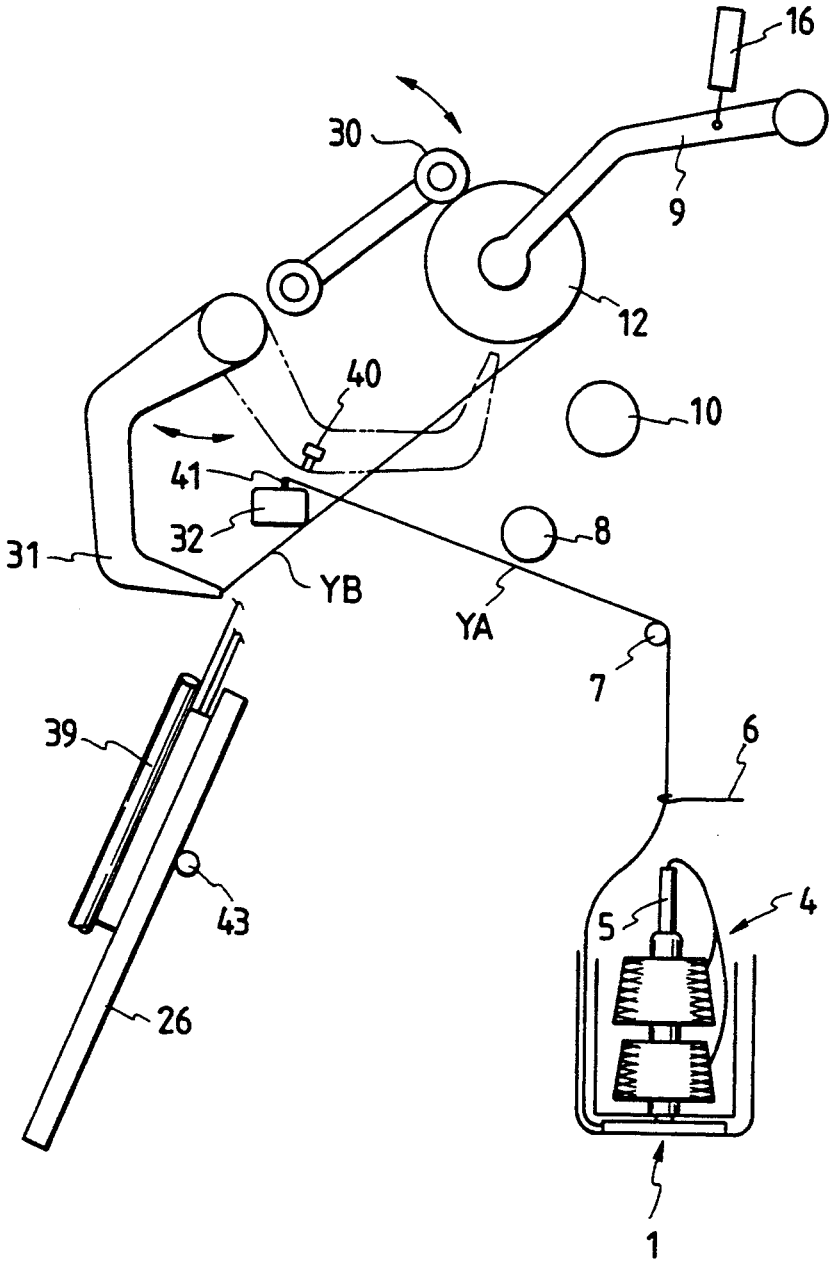
FIG. 4 is a side view showing the state where the robot performs piecing.

In case where the yarn is broken halfway, the yarn Y is torn due to rotation of the spindle 2. Therefore, in case of performing the piecing, the feed package 4 is once transferred onto the temporary place peg 33 and the yarn end finding is carried out by the yarn end finding mechanism 34. The package is then returned to the spindle 2 to effect threading. As shown in FIG. 4, the yarn end YA on the feed side is guided to the piecing device 32 while hooking it on the snail wire 6 and the guide roller 7 by the hook 4 of the operating arm 26. The yarn end YB on the winding side is sucked and released by the suction arm 31 while reversely rotating the winding package 12 by the driving roller 30 and is guided to the piecing device 32. The yarn end YA on the feed side and the yarn end YB on the winding side are subjected to piecing by the piecing device 32.

On the other hand, whether or not the winding package 12 has a predetermined diameter is detected (S4). In case of no-predetermined diameter, whether or not the feed side has a remaining yarn is detected (S8). In case of no-remaining yarn, it is necessary to feed yarn till a predetermined diameter is obtained. Therefore, the replacement of yarn and doffing are carried out (S9) as mentioned above.

In case of no-predetermined diameter and with a remaining yarn, the yarn is broken halfway. Therefore, the piecing is carried as described above (S7).

As described above, the predetermined length feed package 4 is used, and whether or not the winding package 12 of the unit 1 with a yarn breakage has a predetermined diameter or whether or not the feed package 4 has a remaining yarn are detected. The robot 22 is caused to effect predetermined operation according to the aforementioned mode. Therefore, it is possible to form a winding package 12 having a predetermined winding amount from a plurality of feed packages 4 without requiring a yarn length counter and to effect doffing. Accordingly, the feed package 4 can be miniaturized, and the unit 1 is miniaturized by that portion. As a result, the double twister can be implemented into a multi-unit, and the production is increased.

In short, according to the present invention, the predetermined length feed package is used, and whether or not the winding package of the unit with a yarn breakage has a predetermined diameter or whether or not the feed package has a remaining yarn are detected. The robot is caused to effect predetermined operation according to the aforementioned mode so as to form a full winding package having a predetermined winding amount. Thus, a winding package having a predetermined winding amount can be formed from a plurality of feed packages without requiring a yarn length counter. The unit is miniaturized, and the double twister can be implemented into a multi-unit.

Next, a construction of a robot which can travel along the unit of a double twister and is provided with an operating arm for drawing a yarn end from a feed package, a suction arm for drawing a yarn end from a winding package, a yarn hook portion for hooking both the drawn yarn ends, and a piecing device for piecing both the yarn ends at the hook portion will be described referring to FIGS. 6 to 13.

Figure 9:
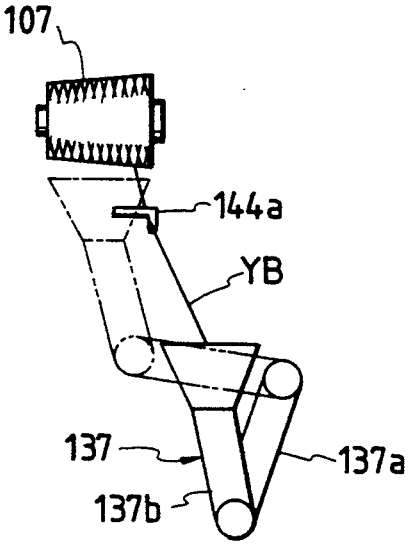
FIG. 9 is a plan view showing the state in which a suction arm draws a yarn end out of a winding package.
Figure 11:
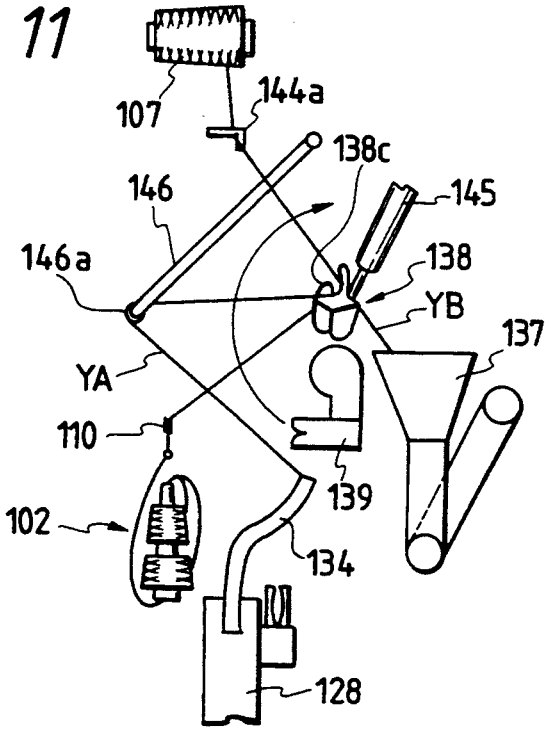
FIG. 11 is a perspective view showing the status in which a piecing device turns to capture both yarn ends on a yarn hook portion.
Figure 12:
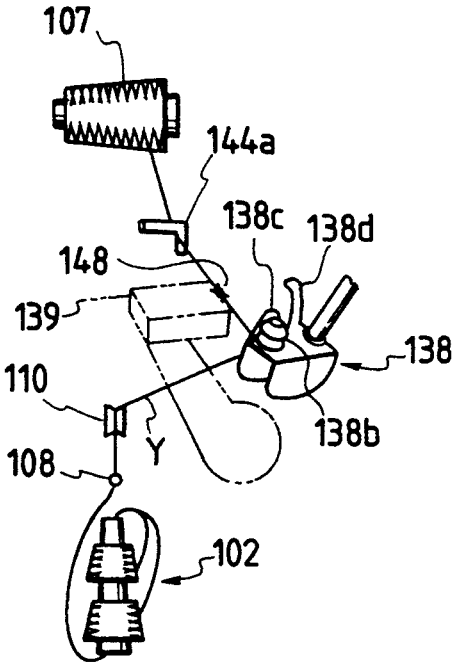
FIG. 12 is a perspective view showing the state in which piecing is accomplished by a piecing device.

On the inner wall **123*b* to the right of the robot body 123 are provided a suction arm 137 for yarn end finding and drawing a yarn end YB adhered to the surface of a yarn layer of the winding package 107 due to the yarn breakage, a yarn hook portion 138 for hooking a yarn end YA drawn out of the feed package 102 by the operating arm 128 and a yarn end YB drawn out of the winding package 107 by the suction arm 137 as shown in FIG. 9, and a piecing device 139 for piecing both the yarn ends YA and YB hooked on the yarn hook portion 138 as shown in FIGS. 11 and 12**.

Figure 8:
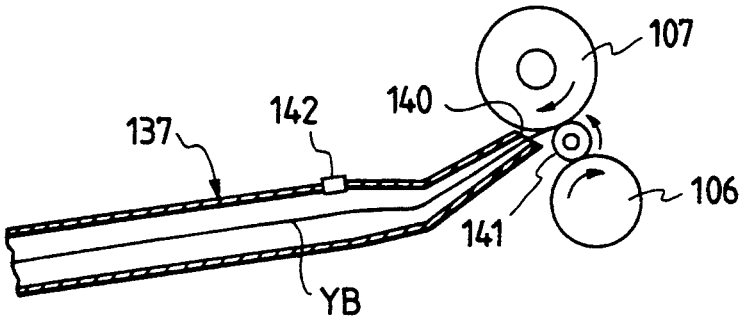
FIG. 8 is a view showing a yarn end finding status of a winding package.

As shown in FIGS. 8 and 9, the suction arm 137 is principally composed of a base arm 137*a* for turning the rotational drum 106 obliquely upwardly and substantially horizontally, and an end arm 137*b* horizontally turnably connected to the extreme end of the base arm 137*a* and having a suction port 140 of substantially the same width as the winding package 107 at the extreme end thereof, so that when the base arm 137*a* is turned, the suction port 140 is moved parallely from a folded return position on the robot body 123 side toward the lower portion of the winding package 107. On the extreme end of the end arm 137*b* is mounted a roller 141 inserted between the rotational drum 106 and the winding package, as shown in FIG. 8, to rotate the winding package 107 in the direction opposite to the winding direction by the rotation of the rotational drum 106.

Halfway of the suction arm 137 is provided a sensor 142 for sensing the yarn end YB sucked from the suction port 140 to continue yarn end finding till the yarn end of scores cm is sucked after detection of the yarn end YB by the sensor 142. This is done because the yarn end YB wound on the winding package 107 is not in the prescribed number of twists due to the yarn breakage, and that portion is removed.

A support frame 143 is mounted on the inner wall 123*b* to the right of the robot body 123, and a yarn control lever 144 having an L-shape control piece 104*a* at the extreme end thereof as shown in FIG. 9 is supported on the support frame 143 so that the lever 144 is risen and fallen in the direction of the unit 101. When the suction arm 137 sucks the yarn end YB from the package 107 to return to the right offset position, the yarn control lever 144 is fallen on the unit 101 side by a cylinder not shown. The control piece 144*a* prevents the yarn end YB from being disengaged from the yarn layer end of the winding package 107.

Figure 10:
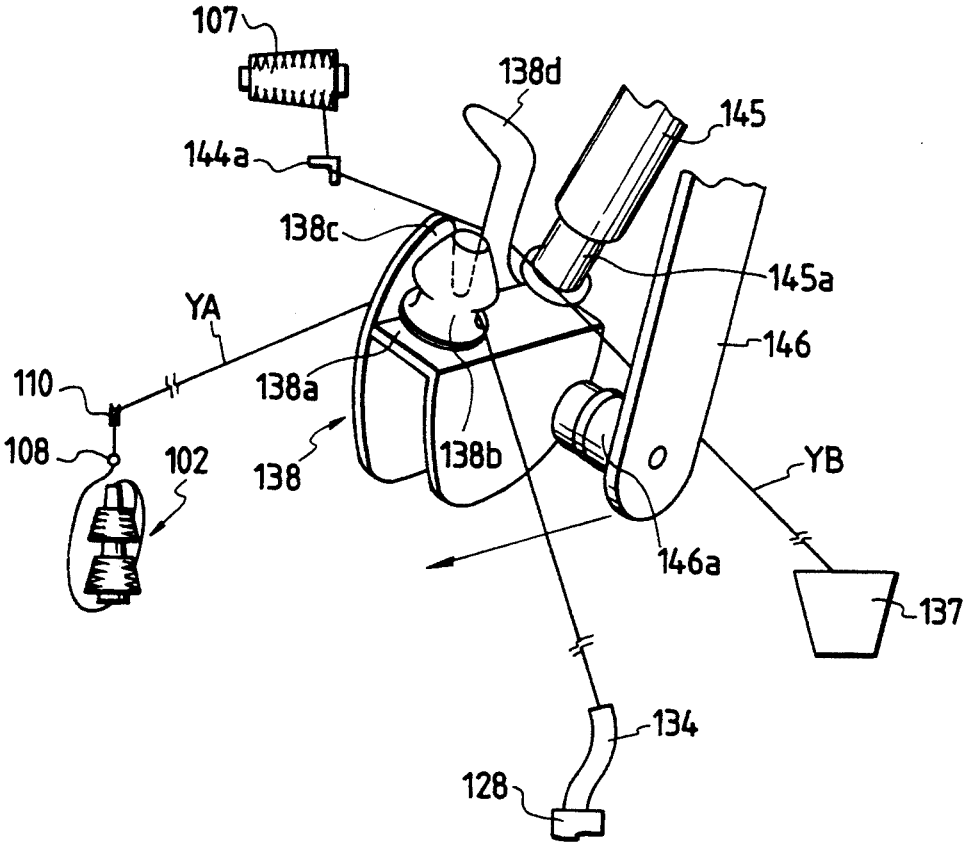
FIG. 10 is a perspective view showing the state in which both yarn ends are hooked on a yarn hook portion.

The yarn hook portion 138 is provided on a piston rod 145*a* of a cylinder 145 mounted frontwardly, obliquely and downwardly from the upper end of the front portion to the right side of the robot body 123 and is composed as shown in FIG. 10 of a roller 138*b* on a horizontal hook surface 138*a*, an angled first projection 138*c* positioned frontwardly of the roller 138*b*, and a ←shaped second projection 138*d* positioned between the first projection 138*c* and the piston rod 145*a*. When the hook portion 138 moves upward, the yarn end YA drawn out of the feed package 102 by the operating arm 128 is hooked between the first projection 138*c* and the second projection 138*d*, and the yarn end YB drawn out of the winding package 107 by the suction arm 137 is hooked between the second projection 138*d* and the piston rod 145*a*.

On the support frame 143, a yarn guide lever 146 having a roller 146*a* at the extreme end thereof is rockably supported at the rear of the hook portion 138. After termination of the hooking to the hook portion 138, the yarn guide lever 146 is rocked leftward by a cylinder not shown so that the roller 146*a* hooks a middle portion of the yarn end YA between the yarn hook portion 138 and the operating arm 128 so as to move it away from the yarn hook portion 138 as shown in FIG. 11.

In the present embodiment, as the piecing device 139, a known knotter for mechanically tying both the yarn ends YA and YB is used but a splicer may be used in which knotless piecing is effected by a turning flow of compressed air. This piecing device 139 is mounted turnably about a vertical shaft 147 below the support frame 143. As shown in FIGS. 11 to 12, the piecing device 139 turns rightward from the standby position at the rear of the yarn hook portion 138 forwardly of the yarn hook portion 138 to capture a middle portion of the yarn end YA between the yarn guide lever 146 and the roller 146*a* and a middle portion of the yarn end YB between the yarn hook portion 138 and the control piece 144*a* whereby the yarn ends are opposed in direction, and the piecing (knotting) between both the yarn ends YA and YB has been carried out, after which it returns to the standby position leftward. The piecing device 139 has a cutter not shown which cuts an extra yarn end from a knot 148 formed by the piecing of both the yarn ends YA and YB, and the surplus yarn end cut thereby is sucked and removed by the suction arm 137 and the suction pipe 134 of the operating arm 128.

In the above-described embodiment, particularly the piecing operation will be described hereinbelow. When a yarn breakage occurs during operation of the unit 1, the drop wire 13 falls to turn on the display lamp 15 (shown in FIG. 1) and the cradle 105 is raised by the cylinder 16. When the lighted display lamp 15 is detected by the sensor 23 during movement of the robot 120, the robot 120 stops in front of the unit 1 and the operating arm 128 assumes a horizontal position. The presence or absence of the remaining yarn on the feed package 102 is assured by the sensor 133. If not remaining yarn is present, replacement of yarn is carried out, and if the remaining yarn is present, piecing starts.

In case where the yarn breakage occurs, one cut yarn end YB is wound on the winding package 107, and out of the other yarn end YA, a portion externally of the spindle 2 is torn by the rotation of the spindle 2. Since a portion internally of the spindle 2 is excessively twisted within the adaptor 5 by the rotation of the spindle 2, the feed package 4 is once transferred to the peg 126 of the robot 120 by the operating arm 128 and the yarn end finding of the yarn end YB is carried out by the yarn end finding mechanism 127.

After termination of yarn end finding, the feed package 4 is returned onto the spindle 2 for threading. The yarn end YA blown upwardly of the spindle 2 is sucked and held by the suction pipe 134 of the operating arm 128. The yarn end YA which is present from the spindle 2 to the suction pipe 134 is hooked on the snail wire 141 and the yarn guide roller 110 by the tilt of the operating arm 128 and the forward and backward movement of the yarn guide piece while being twisted by the rotation of the spindle 2, after which the yarn is guided onto the yarn hook portion 138. After the yarn end YA has been guided to the yarn hook portion 138, the rotation of the spindle 2 remains stopped till termination of the piecing.

On the other hand, at the time of yarn end finding, the drop wire 13 is raised by the operating arm 128 and attracted by an upper electromagnet 149 (see FIG. 1). Therefore, the display lamp 15 is turned off and the cradle 9 is pressed down by the cylinder 16.

The yarn end finding work of the winding package 107 is carried out parallel with the yarn end finding work of the feed package 102. First, as shown in FIG. 8, the cradle lever 134 raises the winding package 107 from the rotational drum 106, and the suction arm 137 extends to insert the roller 141 at the extreme end between the winding package 107 and the rotational drum 106 as shown in FIG. 9. When the cradle lever 136 lowers the winding package 107, the winding package 107 is rotated in the direction opposite the winding direction so that the yarn end YB wound on the yarn layer surface of the winding package 107 is sucked into the suction arm 137 from the suction port 140.

After the passage of a predetermined time when the suction arm 137 sucks scores of cm after the yarn end YB is sensed by the sensor 142, the arm 137 returns as shown in FIG. 9, at which time the yarn control lever 144 falls in the direction of the unit 1 so that the control piece 144*a* prevent disengagement of the yarn end YB from the yarn layer end. When the suction arm 137 returns, the cradle lever 136 raises the winding package 107 from the rotational drum 106 to stop the winding rotation till termination of piecing.

When the yarn hook portion 138 is raised from the cylinder 145, a middle portion of the yarn end YA between the yarn guide roller 110 on the feed package side and the suction pipe 134 of the operating arm 128 is hooked between the first projection 138*c* and the second projection 138*d*, as shown in FIG. 10, and a middle portion of the yarn end YB between the control piece 144*a* on the winding package side and the suction arm 137 is hooked between the second projection 138*d* and the piston rod 145*a*, both of which assume a raised state. Then, when the yarn guide lever 146 is rocked leftward from the rear of the yarn hook portion 138, a middle portion of the yarn end YA between the yarn hook portion 138 and the suction pipe 134 of the operating arm 128 is hooked on the roller 146a at the extreme end thereof to move it away from the yarn hook portion 138.

As shown in FIGS. 11 to 12, in such a state as described above, the piecing device 139 turns rightward from the standby position at the rear of the yarn hook portion 138 frontwardly of the yarn hook portion 138 to capture a middle portion of the yarn end YA between the yarn hook portion 138 and the roller 146*a* of the yarn guide lever 146 and a middle portion of the yarn end YB between the yarn hook portion 138 and the control piece 144*a*. The piecing (knotting) of both the yarn ends YA and YB is carried out, and a surplus yarn end cuted by a cutter not shown is sucked and removed by the suction pipe 134 and the suction arm 137.

Upon termination of the piecing, the piecing device 139 and the yarn guide lever 146 return to their original position, and at the same time, the cradle lever 136 lowers the winding package 107 on the rotational drum 106 to start winding and start rotation of the spindle 2. Thereby, the yarn Y is wound about the yarn guide roller 110 and the roller 138*b* from between the first projection 138*c* and the second projection 138*d* of the yarn hook portion 138, after which it is wound on the winding package 107 via the control piece 144*a*. When the winding of the yarn Y starts, the yarn hook portion 138 is gradually moved down, and the yarn Y is slowly removed from the roller 138*b* of the yarn hook portion 38 so as to free from kink, after which the yarn hook portion 138 and the yarn control lever 144 may be moved upward and returned.

As described above, the robot 120 can automatically perform piecing of each unit, whereby all operations necessary for automatic operation of the double twister can be made to considerably reduce labor. Furthermore, since in prior art, a single winding package 107 is formed from a single feed package 102, and a large feed package 102 has been required to form a large winding package 107. However, since piecing can be made, it is possible to splice a plurality of feed packages 102 to form a large winding package 107. Moreover, the feed package 102 can be miniaturized to thereby miniaturize the spindle 2 and reduce power consumption.

Figure 13:
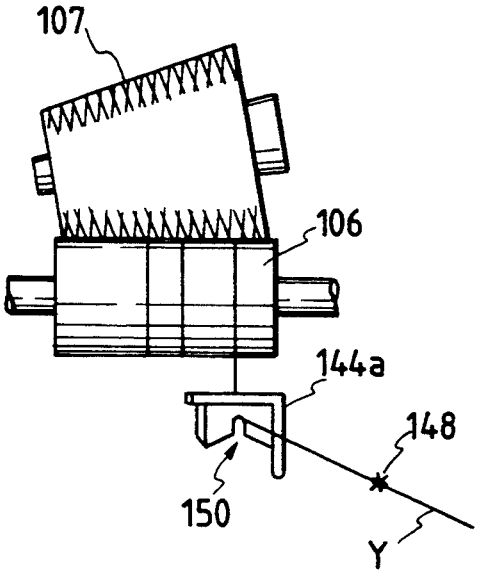
FIG. 13 is a view showing an example in which a pieced up section checking sensor is mounted on a control piece.

While in the above-described embodiment, a description has been made of the case where a two-stage type feed package is used as a feed package, it is to be noted that a single stage type feed package doubled in advance may be used. Furthermore, while in the above-described embodiment, in carrying out piecing, a feed package 102 is once transferred to a peg 126 on the robot 120 side to effect yarn end finding, it is to be noted that since a yarn end YB remains in an adaptor 5, threading may be directly carried out by the action of compressed air obtained by deep stepping operation of a pedal 17 without carrying out yarn end finding operation. In addition, as shown in FIG. 13, a sensor 150 for checking a pieced up section 148 of a yarn Y may be provided on a control piece 144*a* of a yarn control lever 144 to prevent a defective pieced up section or entry of yarn waste.

In short, according to this embodiment of the present invention, yarn ends are drawn out of a feed package and a winding package, respectively, and hooked on yarn hook portions, and both the positioned yarn ends are pieced up by a piecing device. Therefore, it is possible to automatically carry out piecing with respect to a unit in which a yarn breakage occurs.

Figure 17:
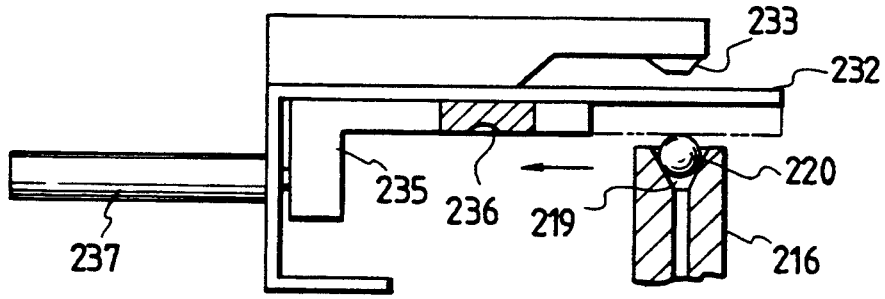
FIG. 17 is a side view showing the operation for returning a ball to a top cap.

For the purpose of suppressing a variation of tension of a yarn during releasing to prevent an occurrence of kink, there is a feed package in which as shown in FIG. 17, a conical concave portion 219 is provided on the upper end of a top cap 216, and a ball 220 called a ball tensor is placed on the concave portion 219. There was a problem in that a conventional robot is difficult to carry out threading since the ball 220 comprises an obstacle to passage of a yarn end during threading.

It is therefore this embodiment provides a robot for a double twister which can easily carry out threading even with respect to a feed package having a ball tensor.

The embodiment of the present invention provides a robot provided with an operating arm for carrying out threading of a feed package supported on a spindle of a double twister, characterized in that said operating arm is provided with a ball retaining portion having a concave portion for attracting and holding a ball mounted on an upper end of a top cap of a feed package during threading by negative pressure.

In threading, the concave portion of the operating arm is moved close to the ball on the top cap, and the ball is attracted and held on the concave portion by negative pressure and removed from the top cap. Thereby, threading can be easily carried out.

Figure 14:
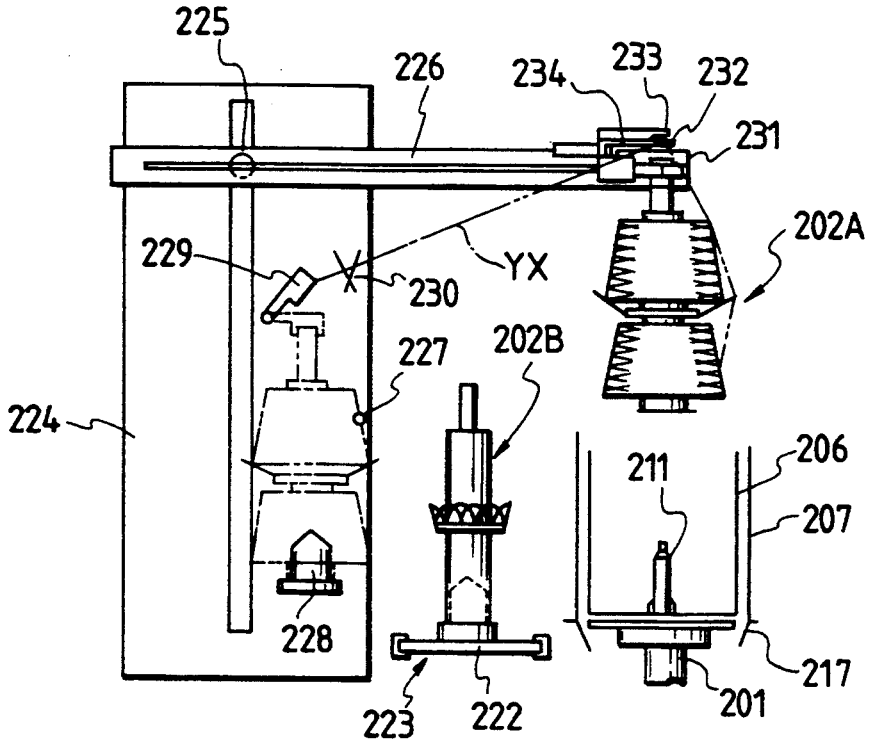
FIG. 14 is a side view showing one embodiment of a robot for a double twister according to the present invention.
Figure 19:
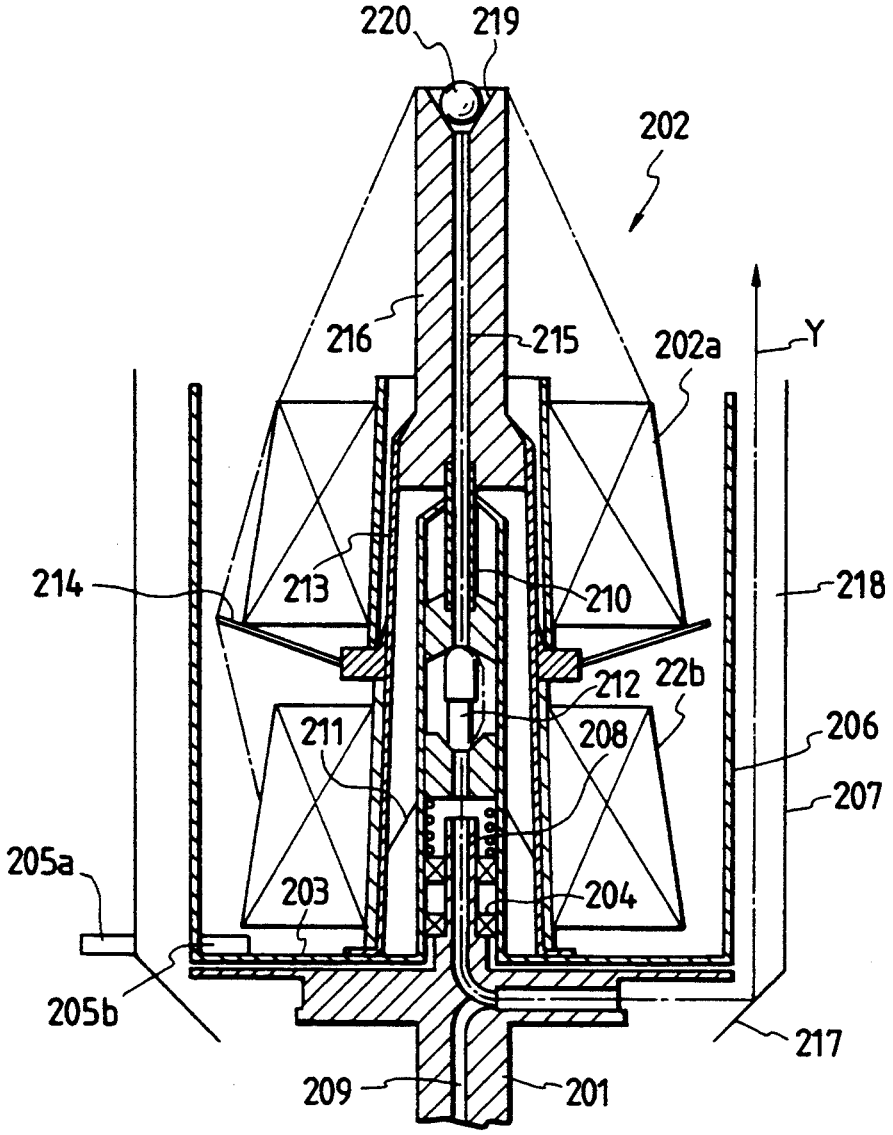
FIG. 19 is a sectional view showing a spindle portion of a double twister.
Figure 20:
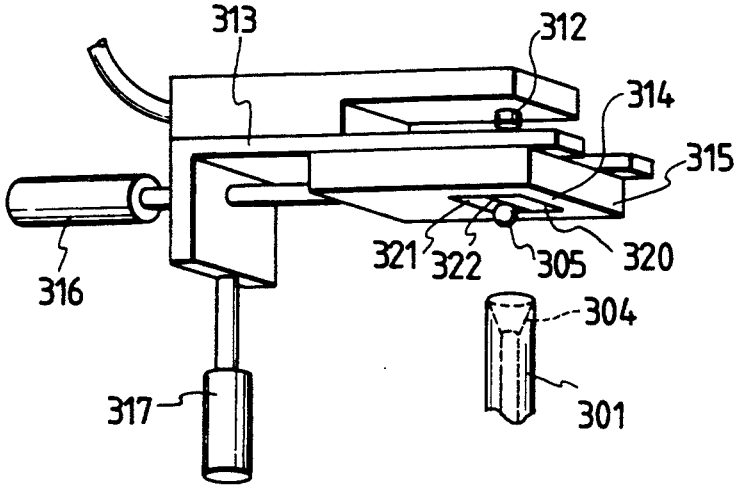
FIG. 20 is a perspective view of an embodiment of the present invention.

In FIG. 14, reference numeral 221 designates a double twister provided with a plurality of juxtaposed units. The spindle 201 is provided on each unit. Frontwardly of the unit is provided along the unit a conveyor 223 for carrying a feed package 202 placed on a tray 222, and a robot 224 positioned frontwardly of the conveyor 223 is provided to run along the unit. The same parts as those shown in FIG. 19 are indicated by the same reference numerals, and description thereof will be omitted.

The robot 224 is provided with a lengthy operating arm 226 pivotally supported on an elevating shaft 225. The operating arm 226 is pulled in while being inclined toward the robot 224 so that when the elevating shaft 225 is moved to its lowermost position, the extreme end thereof is stopped by a stopper 227 so as not to comprise an obstacle during running. In the state in which the extreme end is not stopped by the stopper 227, the robot is moved up and down by the elevating shaft 25 while keeping its horizontal attitude as shown in FIG. 14.

The robot 224 is provided with a temporary place peg 228 for temporarily placing a full feed package 202A carried by a conveyor 223, a yarn end finding suction mouth 229 for sucking and releasing a yarn end wound on an upper end of a top cap 216 of the full feed package 202A on the temporary place peg 228, and a cutter 230 for cutting a yarn end YX which is present from the full feed package 202A on the spindle 201 to the yarn end finding suction mouth 229 during threading.

Figure 16:
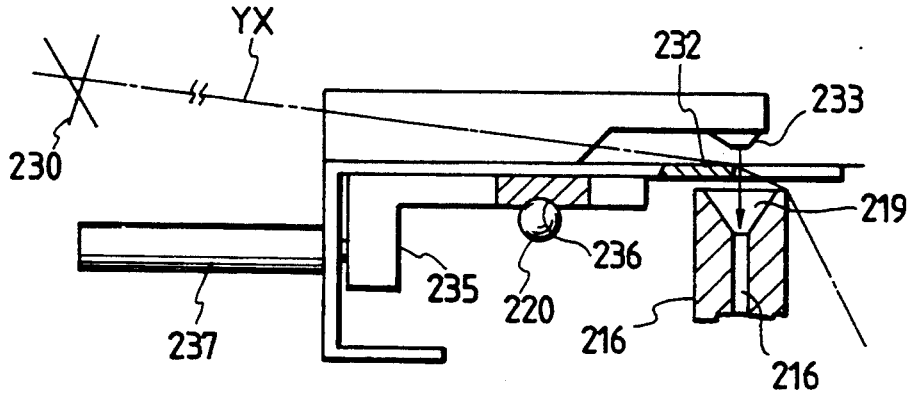
FIG. 16 is a side view showing a ball retaining portion during threading.

A chucker 231 for gripping the top cap 216 of the feed package (including full and empty) 202 is provided longitudinally movably on the side of the operating arm 226, and a yarn stop portion 232 for stopping a middle portion of a yarn end XY which is present from the full feed package 202A to the yarn end finding suction mouth 229 as shown in FIGS. 14 and 16 is provided upwardly of the chucker 231. A threading air nozzle 233 for blowing compressed air into a yarn passage 215 of the to assist threading is provided upwardly of the yarn stop portion 232, and a ball retaining portion 234 having a concave portion 236 for attracting and retaining a ball 220 as a ball tensor placed on the concave portion 219 on the upper end of the top cap 216 by negative pressure is provided below the yarn stop portion 232.

Figure 15:
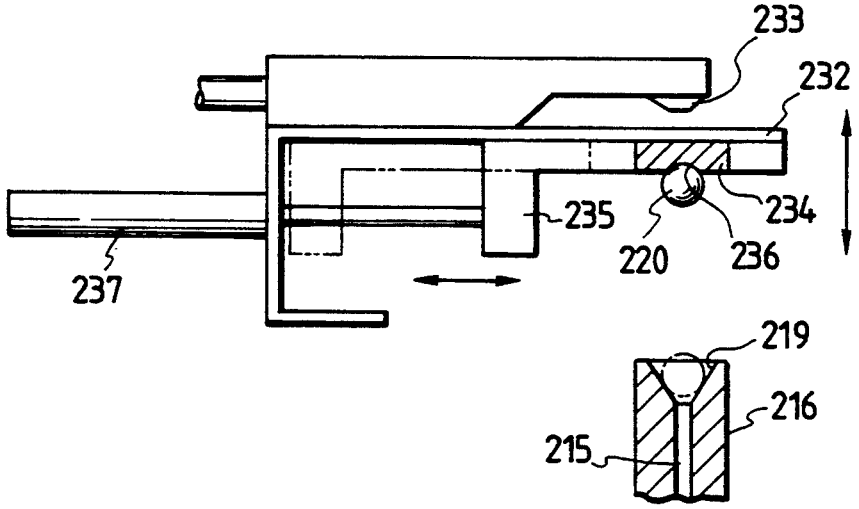
FIG. 15 is a side view showing a ball retaining portion at an operating position.

This ball retaining portion 234 is formed from an elastic member such as rubber or synthetic resin fitted into a frame 235 having an L-shape in section as shown in FIGS. 15 to 17, and is formed in its lower surface with a spherical concave portion 236 corresponding to the upper surface of the ball 220. This ball retaining portion 234 generates a negative pressure in the concave portion 236 similar to a sucker to suck the ball 220, and therefore, the ball retaining portion 234 has an elasticity and airtightness and the concave portion 236 is formed to be the same or somewhat smaller than the curvature of the ball 220. An air cylinder 237 for slidably moving the ball retaining portion 234 along the lower surface of the yarn stop portion 232 is provided on the base end of the yarn stop portion 232 so that when the ball retaining portion 234 is extruded by the air cylinder 237, the concave portion 236 is positioned directly below (operating position) the threading air nozzle 233 as shown in FIG. 15, and when the ball retaining portion 234 is pulled in, the concave portion 236 is positioned at the base end (storing or receiving position) of the yarn stop portion 232 away from the threading air nozzle 233.

The function of the embodiment will be described hereinbelow.

In case of carrying out threading, first, the full feed package 202A is transferred from the tray 222 of the conveyor 223 to the temporary place peg 228 on the robot 224 side by upward- and downward movement of the operating arm 226, and a combination of movement and opening and closing of the chucker 231, and the yarn end wound on the upper end of the top cap 216 of the full feed package 202A is sucked and released by the yarn end finding suction mouth 229 on the temporary place peg 228. The empty feed package 202B is transferred from the spindle 201 to the tray 222 similar to the transfer of the full feed package 202a during the yarn end finding.

Next, when the chucker 231 is moved, a middle portion of the yarn end XY which is present from the full feed package 202A on the temporary place peg 228 to the yarn end finding suction mouth 229 is stopped at the yarn stop portion 232, and the full feed package 202A is transferred to the spindle 201 as shown in FIG. 14 by operation similar to that as described above.

And, the ball retaining portion 234 is moved to the operating position by the air cylinder 237 as shown in FIG. 15, the ball retaining portion 234 is moved close to the top cap 216 of the feed package 202 on the spindle 201 by downward movement of the operating arm 226, and the concave portion 236 is pressed against the ball 220. Then, air is extruded from the concave portion 236 by the ball 220, and the ball 220 is sucked and held by the concave portion by negative pressure similar to the sucker.

Then, the ball 220 is raised from the concave portion 219 of the top cap 216 by upward movement of the operating arm 226, the ball retaining portion 234 is moved to the receiving position by the air cylinder 237, and the threading air nozzle 233 is moved close to the top cap 216 by downward movement of the operating arm 226. In this state, compressed air is caused to act on the air passage 209 of the spindle 201 to produce a suction air flow in the yarn passage 208, compressed air is jetted into the yarn passage 215 of the top cap 216 from the threading air nozzle 233, and at the same time, the yarn end XY which is present from the full feed package 202A to the yarn end finding suction mouth 229 is cut by the cutter 230. Then, the yarn end XY pass through the yarn passages 215, 210 and 208 from the upper end of the top cap 216, is bended at the inclined plate 217, and is blown up through the clearance 218 between the stationary tube 206 and the balloon control tube 207 to complete threading.

Upon termination of threading, the ball retaining portion 234 is moved to the operating position as shown in FIG. 15 and the ball 220 is put into the concave portion 219 of the top cap 216 by downward movement of the operating arm 226. In this state, the ball retaining portion 234 is moved to the receiving position as shown in FIG. 17 whereby the ball 220 is left in the concave portion 219 of the top cap 216 to complete mounting of the ball 220 with respect to the top cap 216.

As described above, the ball 220 is sucked and held in the concave portion 236 of the ball retaining portion 234 by negative pressure, and therefor, the ball 220 may be formed of any material unlike a magnet. Accordingly, as the ball 220, a steel ball may be used of course, and a non-magnetic body such as ceramic may also be used.

Figure 18:
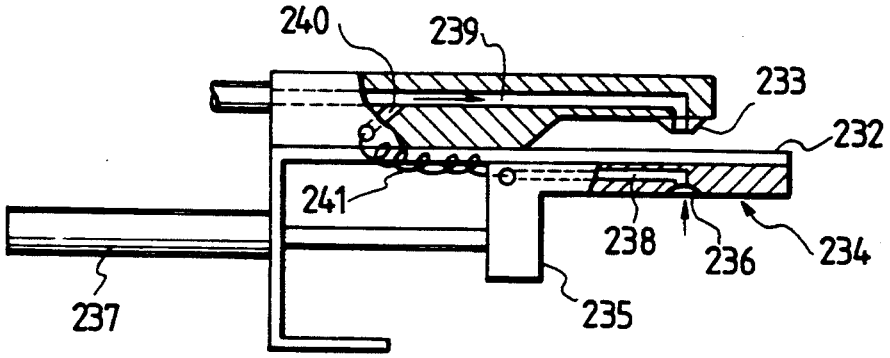
FIG. 18 is a partly sectional side view showing another embodiment of the ball retaining portion.

While in the embodiment, the concave portion 236 of the ball retaining portion 234 is configured similar to a sucker, it is to be noted that as shown in FIG. 18, an air suction hole 238 for positively producing negative pressure in the concave portion 236 may be provided. In this case, an air suction source is connected to the air suction hole 238 but as an air suction source, a suction passage 240 may be provided in which negative pressure is produced by ejector effect in the compressed air passage 239 of the threading air nozzle 233. A flexible hose 241 is provided to connect between the suction passage 240 and a vapor air suction hole 238.

In short, according to this embodiment of the present invention, in threading, the ball on the top cap is sucked in the concave portion of the ball retaining portion provided on the operating arm by negative pressure, and can be removed from the top cap. Therefore, threading can be easily carried out with respect to the feed package having a ball tensor.

Furthermore, in another embodiment of the present invention a robot provides a magnet for mounting and removing, from a ball receiver, a steel ball for a tensor provided with a steel ball which is placed in a ball receiver formed at a top of a spindle and which applies tension to a yarn between ball receivers, wherein magnets having an N-pole and an S-pole vertically positioned with respect to a support member for vertical movement and forward and backward movement are fixed adjacent to each other so that the directions of poles are different from each other.

The embodiment is constructed as described above. When a ball is removed from the ball receiver, the magnet support member is moved forward to position the magnet on the spindle, and when moved down, a steel ball is attracted on the magnet by an attraction force thereof. At that time, the steel ball attracted on the bottom of the magnet is attracted and held on the adjacent surface of the magnet having poles different from each other. Thereafter, the support member is moved upward and moved backward to open the upper portion of the ball receiver to effect threading within the spindle. After termination of threading work, the support member is moved forward to position the adjacent surface of the magnet at the upper portion of the ball receiver, after which the support member is moved down to position the steel ball within the ball receiver. Then, when the support member is moved backward as it is, the steel ball is drawn by the upper edge of the ball receiver within the latter and rolls on the bottom of the magnet. When the magnet is moved away from the upper edge of the ball receiver, the steel ball falls into the ball receiver and the steel ball tensor is mounted.

Figure 22:
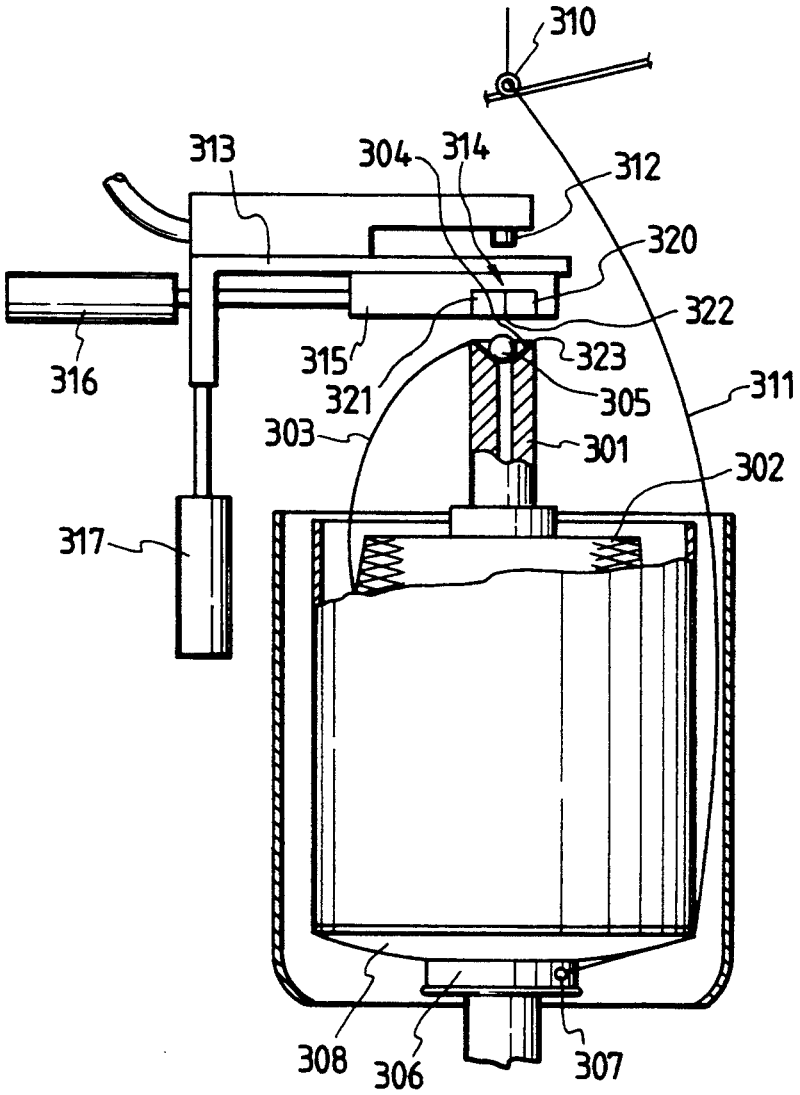
FIG. 22 is a side view showing a partial section of a double twister provided with apparatus according to the present invention.

In a double twister of which entire structure is schematically shown in FIG. 22, a yarn 303 released from a package 302 inserted into and fixed to a spindle 301 passes through between a conical ball receiver 304 formed at a top of the spindle 301 a steel ball 305 placed on the ball receiver 304, and is applied with a predetermined tension by own weight of the ball, which enters into the spindle 301. This yarn is twisted within the spindle 301, and moved out of a hole 307 of a storage disk 306 at the lower part of the package to form a predetermined balloon 311 adjacent to a guide 310 upwardly of the package while being guided by a rotary disk 308 whereby the yarn is double-twisted and wound on the package.

This steel ball 305 comprises an obstacle during threading into the spindle 301 and is therefore temporarily removed from the ball receiver 304. The steel ball 305 is again mounted after threading. To this end, a support bed 315 for mounting a magnet 314 is provided movably by a cylinder 316 on the lower surface of a mounting bed 313 for mounting an air nozzle 312 for blowing a yarn into the spindle 301. The mounting bed 313 is provided vertically movably by a cylinder 317, and when the mounting bed 313 is moved upward and downward, the air nozzle 312 and the support bed 315 are also integrally moved up and down.

Figure 21:
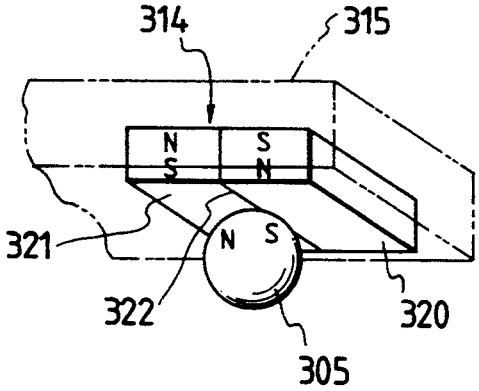
FIG. 21 is a perspective view of a magnet according to the present invention.

As shown in FIG. 21, the magnet 314 is composed of a first magnet 320 in which a lower side is N-pole and an upper side is S-pole, and a second magnet 321 in which a lower side is S-pole and an upper side is N-pole, both first and second magnets being positioned adjacent to each other. The magnet 314 is integrally fixed to the support bed.

In the above-described structure, in normal operation, the steel ball 305 is placed on the ball receiver 304, and tension is applied to the yarn 303 by own weight of the steel ball 305.

When threading into the spindle 301 takes place, the cylinder 316 is actuated in the state in which the mounting bed 313 is moved upward by the cylinder 317 to move forward the support bed 315 and position the magnet 314 above the spindle 301. Then, the cylinder 137 is actuated to move down the mounting bed 13 so that the magnet 314 is moved close to the steel ball 305. The steel ball 305 is then attracted by the magnet 314 from the ball receiver 304. Thereafter, the cylinder 317 is actuated to move up the mounting bed 313, and the cylinder 316 is further actuated to withdraw the steel ball 305 from the top of the spindle 301. In this state, the yarn end of the package 302 is carried to the top of the spindle 301. Threading is carried out within the spindle 301 by high pressure air from the air nozzle 312 positioned on the top of the spindle 301 and suction air sucked from the bottom of the spindle 301.

When the steel ball 305 attracted on the magnet 314 is attracted close to the adjacent edge 322 of the first magnet 320 and the second magnet 321, the steel ball 305 is formed with S-pole in a portion corresponding to N-pole of the bottom of the first magnet 320, and N-pole corresponding to S-pole of the first magnet 321. The S-pole of the steel ball 305 and the S-pole of the second magnet 321 repulse each other, and the N-pole of the steel ball 305 and the N-pole of the first magnet 320 repulse each other. The steel ball 305 is moved to and held at the position of the adjacent edge 322 of the first magnet 320 and the second magnet 321.

After termination of threading into the spindle 301, the cylinder 316 is actuated to Move forward the support bed 315, and when the adjacent edge 322 of the preset magnet 314 moves to the position at the center of the top of the spindle 301 and stops, the steel ball 305 held on the portion of the adjacent edge 322 is positively held without rolling on the bottom of the magnet 314 even when the support bed 316 moves and positioned at the center of the top of the preset spindle 301.

Then, when the cylinder 317 is actuated to move down the mounting bed 313, the steel ball 305 enters a space of the ball receiver 304. Next, when the cylinder 315 is actuated to withdraw the support bed 316, the steel ball 305 stayed within the ball receiver 304 stops its movement by the upper edge portion 323 of the ball receiver 304 and rolls on the bottom of the magnet 314 which moves in such a manner as to be drawn. When the magnet 314 is disengaged from the upper edge portion 323, the steel ball 305 is moved away from the magnet 314 and falls into the ball receiver 304.

When the double twister is actuated after withdrawal of the support bed 316, the yarn is applied with a predetermined tension by the steel ball 305 and performs normal operation.

The embodiment of present invention is constructed as described above. The operation for removing and mounting the steel ball within the ball receiver by the magnet can be automated. Furthermore, since the steel ball is held on the adjacent edge of the magnet having different magnetic poles, the steel ball is positively held in position without lolling on the magnet surface even during movement of the magnet. The steel ball is held in position as described, and as the result, when the magnet is moved to a predetermined set position, the steel ball is accurately guided to the position directly above the spindle, and the steel ball can be positively mounted.

Next, a connection apparatus which can completely automate supply and discharge processing of packages and empty bobbins between a double twister and a winder will be described hereinafter. The present invention provides an apparatus for connecting a winder and a double twister in which in order of upstream side along a tray carrier passage for connecting an empty bobbin carrier passage and a package carrier passage of a double twister are arranged a stripper for stripping off a remaining yarn from an empty bobbin to fall it into a chute, a bobbin mover for removing an empty bobbin from a spindle stood upright on a tray to deliver it to the stripper and likewise removing a release tension adjusting guide to mount it on the spindle stood upright on the tray at a package mounting position, a yarn exchange device for removing a package carried in by a gate conveyor from a winder to mount it on the spindle stood upright on the tray at the mounting position, and a yarn end finding device for finding yarn ends of packages mounted in two stages on the spindle stood upright on the tray, the empty bobbin fallen into the chute being supplied to an autodoffer of the winder by a conveyor.

In the connection apparatus for a winder and a double twister as described above, a two-stage empty bobbin and a release tension adjusting guide sandwiched therebetween are mounted on a spindle stood upright on a tray and enter a tray carrier passage from an empty bobbin carrier passage of the double twister. When they move before a bobbin mover, an empty bobbin is removed and delivered to a bobbin stripper. The release tension adjusting guide is placed on the first package already mounted on the spindle stood upright on the tray at the package mounting position. In the bobbin stripper, a remaining yarn is stripped off, and an empty bobbin is fallen into a chute and supplied to an autodoffer of a winder by a conveyor. On the other hand, at the mounting position, a package carried in by a gate conveyor from the winder is removed by a yarn exchange device and mounted on the spindle stood upright on the tray. In a tray in which a package and a release tension adjusting guide have been mounted, each yarn end is found by a yarn end finding device and fed from a tray carrier passage to a package carrier passage of the double twister.

An embodiment of the present invention will be described with reference to FIGS. 23 to 27 by way of an example of a connection apparatus in an autowinder and a two-stage feed type double twister.

Figure 23:
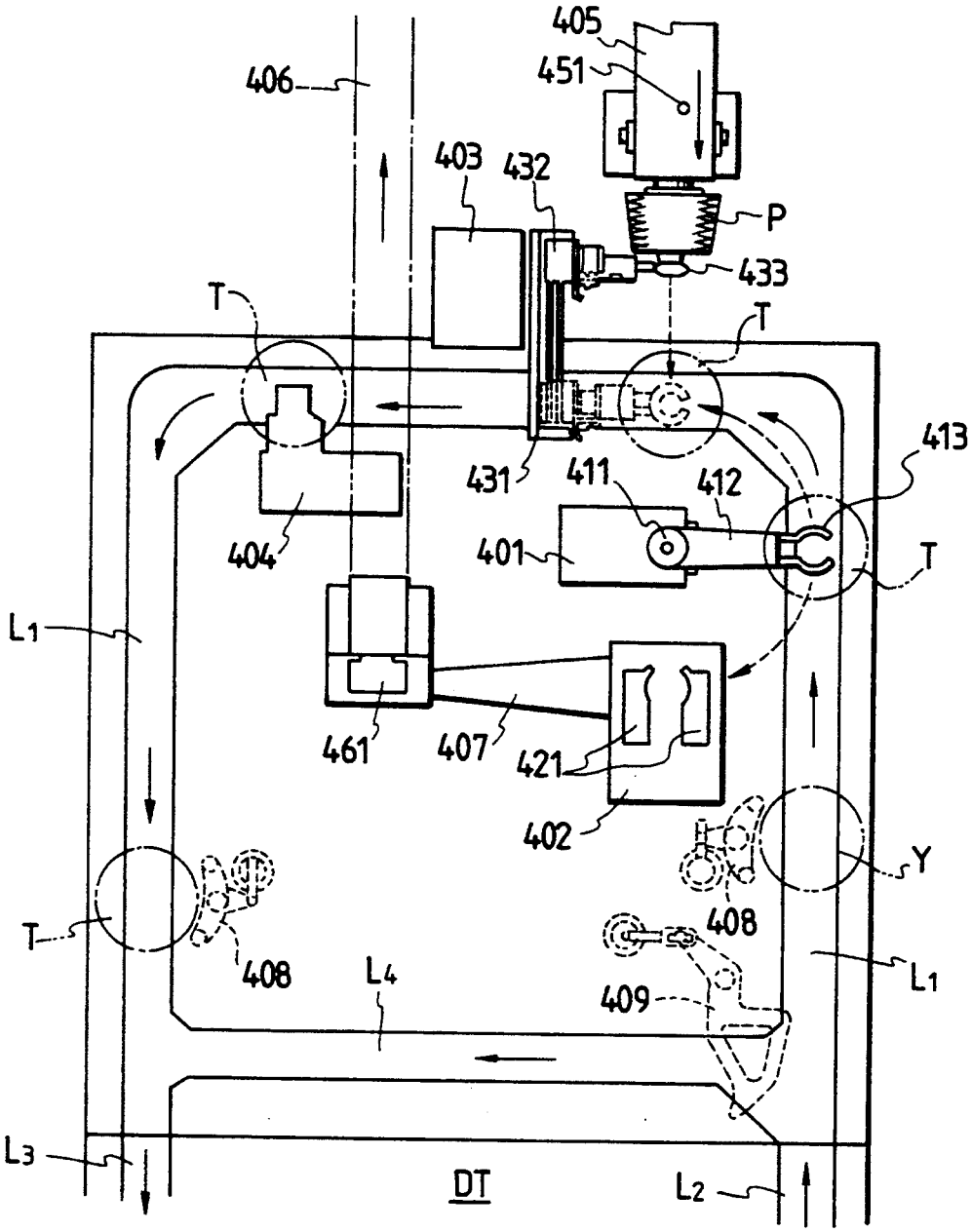
FIG. 23 is a plan view of a connection apparatus for a winder and a double twister according to the present invention.

As shown in FIG. 23, this connection apparatus is positioned between an auto winder and a double twister DT and installed adjacent to the double twister DT. The apparatus has a main carrier passage $L_1$ for carrying a tray for connecting an empty bobbin carrier passage $L_2$ and a package carrier passage $L_3$. This apparatus and the autowinder are communicated by a gate conveyor 405 for receiving a package and an empty conveyor 406 for delivering an empty bobbin archwise extended overhead.

In this connection apparatus, in order of upstream side along a main carrier passage $L_1$ are arranged a stripper 402 for stripping off a remaining yarn from an empty bobbin to fall it into a chute 407, a bobbin mover 401 for removing the empty bobbin B from a tray T to deliver it to the stripper and removing a release tension adjusting guide G from the tray T to deliver it toward a yarn exchange device 403, a yarn exchange device 403 for receiving a package P carried in by a gate conveyor 405 to mount it on the tray T, and a yarn end finding device 404 for yarn end finding a yarn end of a package P mounted in two stages on the tray T. Tray stoppers 408 are installed at upstream and at downstream of the main carrier passage $L_1$, an empty bobbin mounting tray carried from the empty bobbin carrier passage $L_2$ and a package mounting tray carried into the package carrier passage $L_3$ are temporarily stopped at their positions till the downstream side is ready. Although not shown, similar tray stoppers 408 are installed at positions of the bobbin mover 401, the yarn exchange device 403 and the yarn end finding device 404 in order to keep the tray T stopping during work.

The connection apparatus is further provided with a sub-carrier passage $L_4$ for communicating the empty bobbin carrier passage $L_2$ and the package carrier passage $L_3$ of the double twister DT. In the sub-carrier passage $L_4$, when the main carrier passage $L_1$ is filled with empty bobbin mounting trays and a distribution lever 409 rocks to close the main carrier passage $L_1$, the empty bobbin mounting tray is fed toward the package carrier passage $L_3$.

Figure 24:
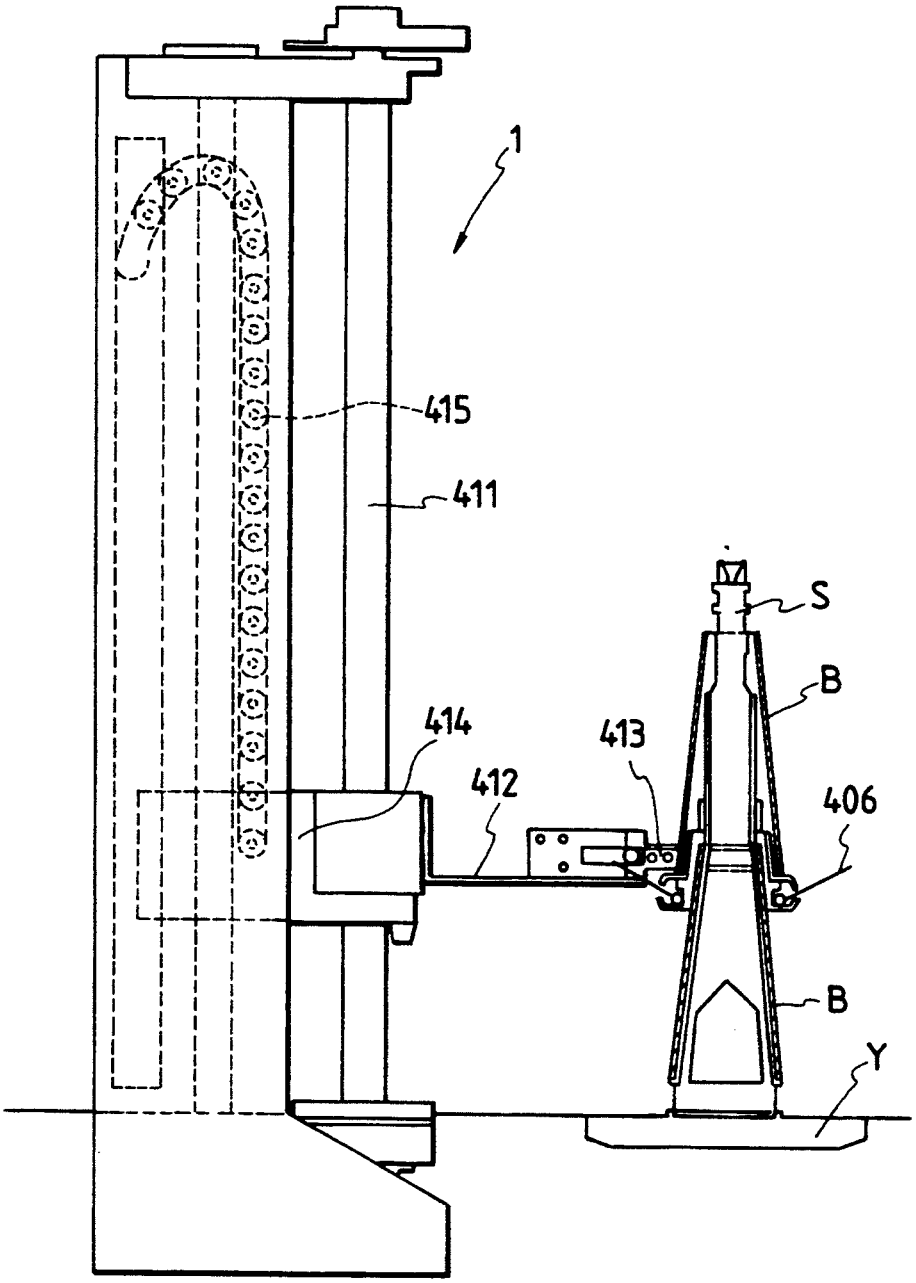
FIG. 24 is a side view of a bobbin mover.

The bobbin mover 401 is provided at the extreme end with a chuck 413, as shown in FIG. 24, and can be moved upward and downward along a vertical shaft 411, and further has a chuck support arm 412 which can be turned toward the yarn exchange device 403 and the stripper 402, as indicated by the dotted line in FIG. 23, about an empty bobbin removing position. The chuck support arm 412 is moved upward and downward by vertically moving the other end of a chain 415 having a suitable length whose one end is connected to the support member 414. The chuck 413 is normally opened to be larger than a diameter of the empty bobbin B and the release tension adjusting guide G to grip them by supplying air. The chuck support arm 412 normally stands-by above the empty removing device.

A two-stage empty bobbin mounting spindle S holding the release tension adjusting guide G in the intermediate thereof moves into the main carrier passage $L_1$ from the empty bobbin carrier passage $L_2$ of the double twister T stood upright on the tray T and stops before the bobbin mover 401. Then, the chuck support arm 412 slightly moves down, and the chuck 413 grips an upper empty bobbin B. In this state, the chuck 413 releases the empty bobbin B and returns to its original position. Then, the chuck support arm 412 further moves down, and the chuck 413 grips the release tension adjusting guide G. In that state, the chuck support arm 412 moves upward and turns upwardly of the tray T having one package already mounted on the spindle S at the mounting position of the yarn exchange device 403. The chuck 413 then releases the release tension adjusting guide G and returns to its original position. The lower empty bobbin B is released toward the stripper similar to the upper empty bobbin B.

Figure 25:
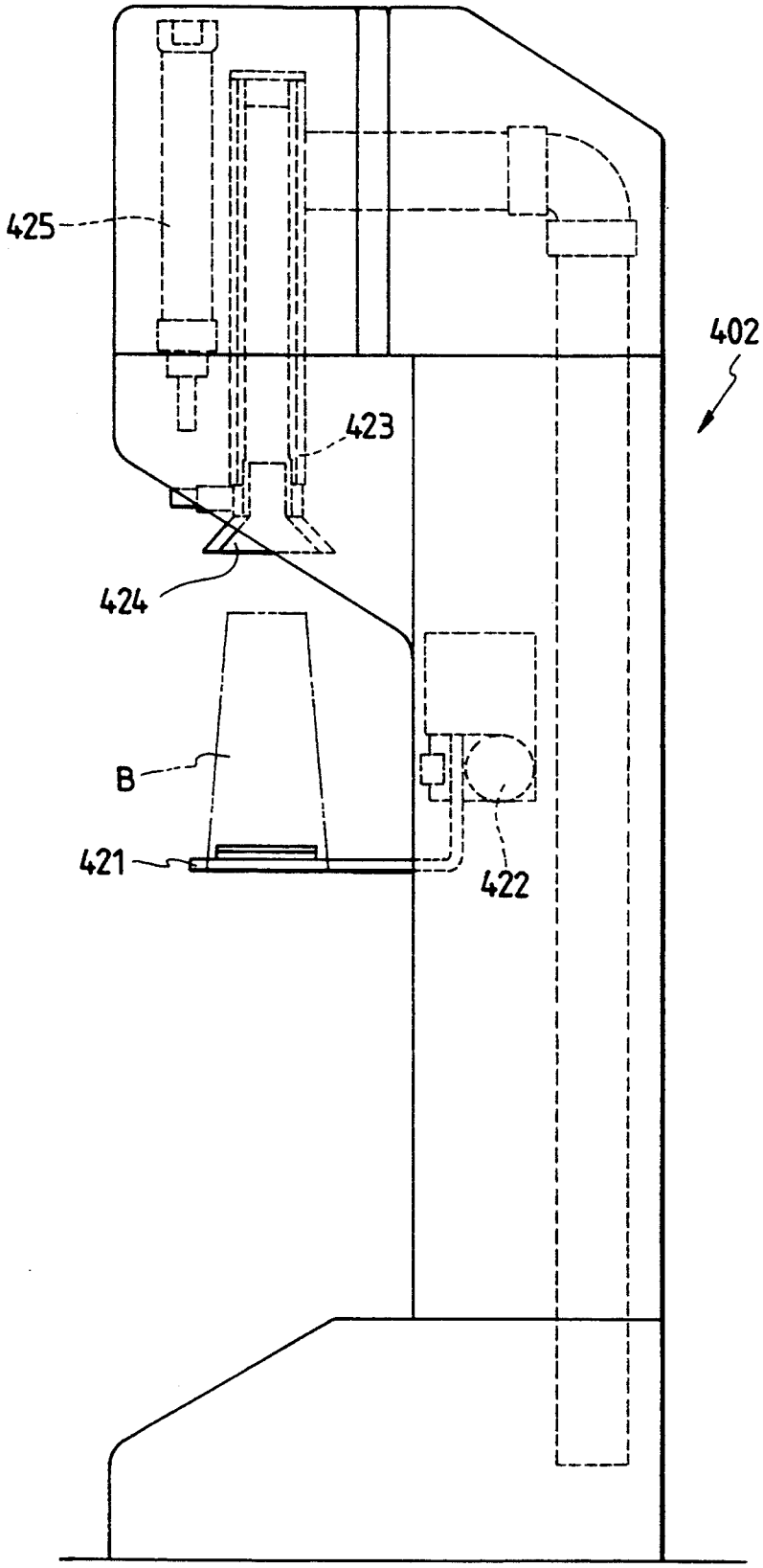
FIG. 25 is a side view of a stripper.

The stripper 402 has a chuck 421 for gripping the lower end of the empty bobbin B, as shown in FIG. 25, and normally stands-by with the chuck 421 opened to receive an empty bobbin B released from the chuck 413 of the bobbin mover 401. The chuck 421 is constant in its upper and lower positions but they are moved to and away from each other by an air cylinder 422, and approach simultaneously with reception of an empty bobbin B to grip the empty bobbin B. Upwardly of the chuck 421 are provided a yarn suction pipe 423 in communication with a duct and a pusher 424 which is slidably supported therein, urged upwardly by means of a spring not shown and moved downwardly by an air cylinder 425 during yarn stripping work. When the chuck 421 receives the empty bobbin B from the chuck 413 of the bobbin mover 401 to grip it, the air cylinder 425 is actuated to move down the pusher 424 and press down the empty bobbin B. As the empty bobbin B moves down, the chuck 421 gradually approaches while adjusting to a conical outer diameter of the empty bobbin B. If a remaining yarn is present on the empty bobbin B, this yarn is drawn by the edge of the chuck 421 and stripped off from the empty bobbin B. When the empty bobbin B is lowered by the pusher as described above, the pusher 424 somewhat moves upward, and the stripped off remaining yarn is sucked by the yarn suction pipe 423 and discharged. The empty bobbin B is falled onto the chute 407, from which it is scraped by a place plate 461 of an empty bobbin conveyor 406 provided at regular intervals and supplied to an autodoffer on the autowinder side.

Figure 26:
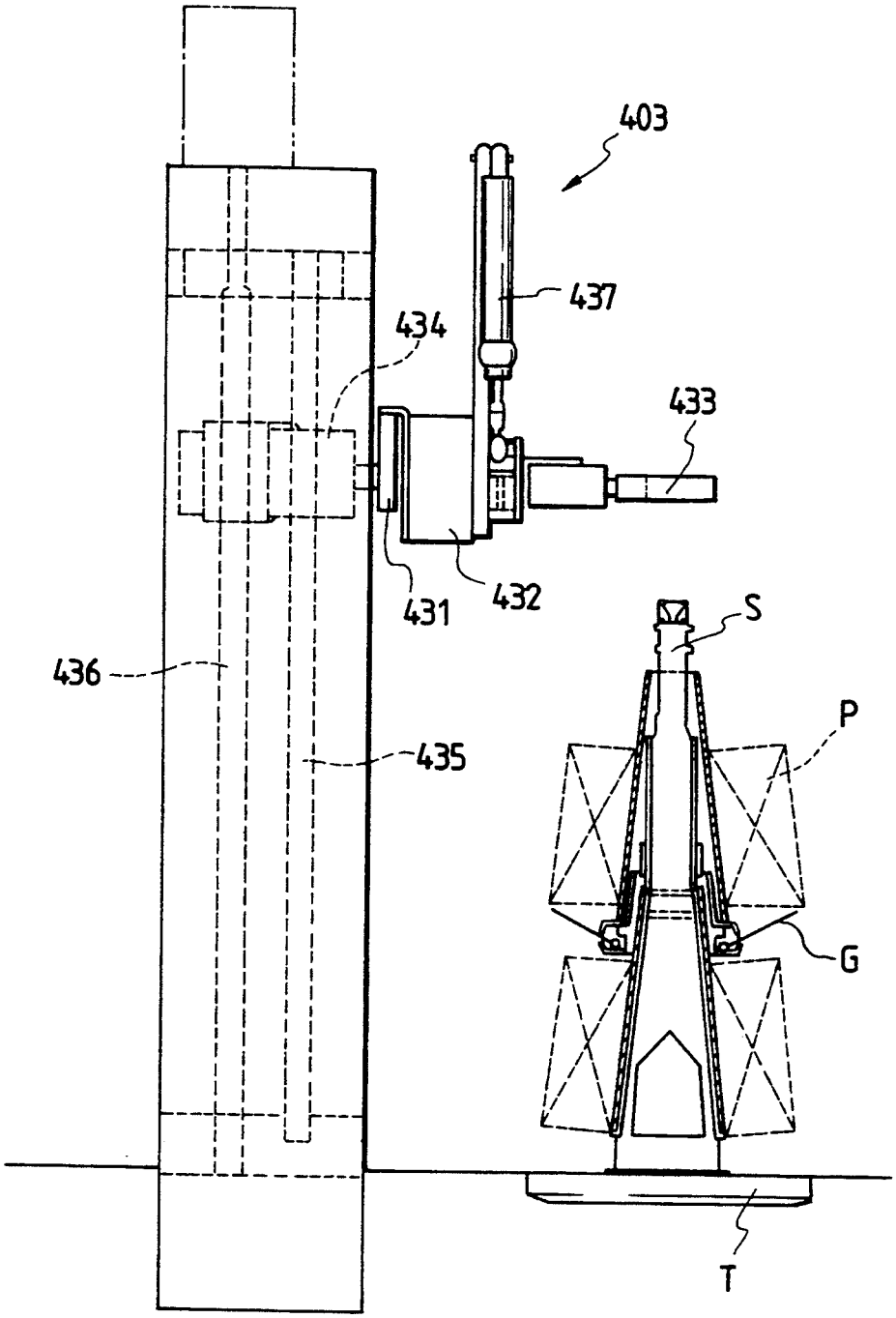
FIG. 26 is a side view of a yarn exchange device.

The yarn exchange device 403 is composed, as shown in FIG. 26, a vertically movable sliding frame 431, a chuck support 432 which is mounted on the sliding frame 431 and which horizontally slides between a removing position for removing a package P from pegs 451 mounted at equal intervals on the gate conveyor 405 and a mounting position for inserting a package P into a tray T which stands-by in front of the yarn exchange device 403, and a chuck 433 which is supported on the chuck support 432 and which rotates through 90° when the chuck support 432 is at the mounting position. The chuck 433 normally stands-by at the removing position with the chuck vertically opened and which receives an extreme end of a bobbin of a package P carried while being laterally supported on the peg 451 at a vertical portion of the gate conveyor 405 and which is closed by a supply of air. A mounting member 434 of the sliding frame 431 is supported on a shaft 435 and vertically moved by rotation of a screw shaft 436. The rotation of the chuck 433 is effected by an air cylinder 437.

When the extreme end of the-bobbin of the package P laterally carried by the gate conveyor arrives at the chuck 433 which stands-by at the removing position, the chuck 433 is closed to grip the package P. The chuck 433 is then moved to the mounting position along with the chuck support 432, where the chuck 433 rotates through 90° to set the attitude of the package P to be vertical, and the chuck 433 is then moved down with the sliding frame 431 and opened so that the package P being gripped is inserted into the spindle P stood upright on the tray T.

Figure 27:
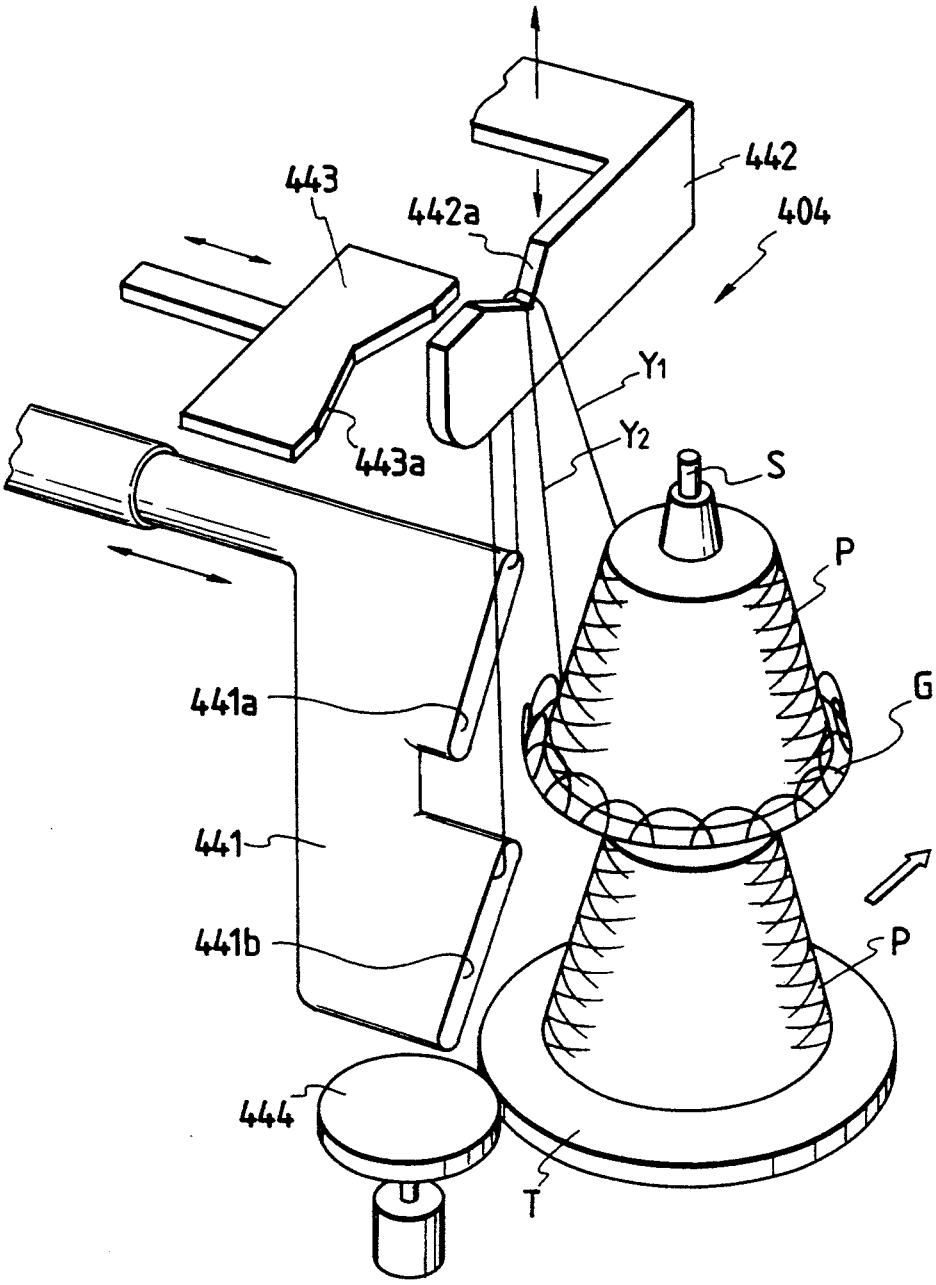
FIG. 27 is a schematic perspective view of a yarn end finding device.

The yarn end finding device 404 is composed, as shown in FIG. 27, two openings 441*a* and 441*b* along the vertical direction of the peripheral side of the packages P in two stages on the spindle S of the tray T, a suction mouth which withdraws after moving close to the peripheral side of the package P to suck and hold the yarn end, a yarn guide 442 having a concave portion 442*a* at the upper edge thereof and which moves upward from the lower standby position to hook yarns $Y_1$ and $Y_2$ extended between the suction mouth 441 and the package P and moves upward from the upper end of the spindle S, a yarn guide 443 having a concave portion 443*a* at the front edge thereof and which hooks yarns $Y_1$ and $Y_2$ extended between the yarn guide 442 and the package P and moves forward from the rear standby position to the upper end of the spindle S, and a device 444 for rotating a yarn on the tray T in a direction of releasing a yarn when the yarns $Y_1$ and $Y_2$ are sucked by the suction mouth 441 and in a direction of winding a yarn when the yarn guide 443 moves forward to the upper end of the spindle S. The suction mouth 441 is interiorly provided with a shutter cutter (not shown) for cutting and holding a sucked yarn for determining a yarn winding length to the upper end of the spindle S to a predetermined length.

The packages P are superposed in two stages by the yarn exchange device 403 at the mounting position, and when the tray T with the release tension adjusting guide G mounted thereof is moved along the main carrier passage $L_1$ by the bobbin mover 401 and arrives at the yarn end finding device 404, the suction mouth 441 moves forward to suck the yarns $Y_1$ and $Y_2$ from the peripheral side of the packages P and then moves backward. At that time, the tray T is rotated in a direction of releasing a yarn by a rotational device 444. Then, the yarn guide 442 moves upward to hook the yarns $Y_1$ and $Y_2$ and stops upwardly of the upper end of the spindle S. Thereafter, the yarn guide 443 moves forward to hook the yarns $Y_1$ and $Y_2$ and moves forward to the upper end of the spindle S. When the tray T is rotated in a direction of winding a yarn by the rotational device 444, the yarns $Y_1$ and $Y_2$ are wound on the upper end of the spindle S, and the suction pipe 445 is actuated so that the remaining yarn ends are sucked into a hollow portion of the spindle S. The two-stage package P with the yarn end thus found moves along the main carrier passage $L_1$ and is fed to the double twister DT. It is to be noted that the yarn guide 43 is omitted, and the yarn guide 442 moves upward with the yarns $Y_1$ and $Y_2$ hooked thereon, and thereafter further moves forward to carry the yarns $Y_1$ and $Y_2$ to the upper end of the spindle S.

This invention has a construction as described above, and has the effect described below.

The supply and discharge processing of packages and empty bobbins between the winder and the double twister can be completely automated without requiring hands.

What is claimed is:

1. A method of operating a robot device for a double twister, the double twister comprising a plurality of units, each of the units configured for supporting a winding package and a feed package, the winding package defining a yarn end and the feed package defining a yarn end, the method comprising:

detecting a unit having a yarn breakage, detecting whether the unit having the yarn breakage has a winding package having a predetermined diameter and which a yarn feed package has yarn remaining thereon, exchanging the yarn feed package and doffing the winding package when a winding package having a predetermined diameter is detected and yarn remaining on the feed package is not detected, exchanging the yarn feed package and piecing the yarn end of the winding package and the yarn end of the feed package when a winding package having a predetermined diameter is not detected and yarn remaining on the feed package is not detected, and piecing the yarn end of the winding package and the yarn end of the feed package when a winding package having a predetermined diameter is not detected and yarn remaining on the feed package is detected.

2. In a double twister comprising a plurality of units, each of the units configured for supporting a winding package and a feed package, the winding package defining a yarn end and the feed package defining a yarn end, a robot device configured for traveling along the units of the double twister, a robot device comprising:

means for detecting a unit having a yarn breakage, means for detecting whether the unit having the yarn breakage has a winding package having a predetermined diameter and a yarn feed package having yarn remaining thereon, means for exchanging the yarn feed package and doffing the winding package when a winding package having a predetermined diameter is detected and yarn remaining on the feed package is not detected, means for exchanging the yarn feed package and piecing the yarn end of the winding package and the yarn end of the feed package when a winding package having a predetermined diameter is not detected and yarn remaining on the feed package is not detected, and means for piecing the yarn end of the winding package and the yarn end of the feed package when a winding package having a predetermined diameter is not detected and yarn remaining on the feed package is detected.

3. The device of claim 2, wherein the means for piecing comprises:

an operating arm for drawing a yarn end from the feed package, a suction arm for drawing a yarn end from the winding package, a yarn hook portion for hooking the yarn end drawn from the feed package and the yarn end drawn from the winding package, and a piecing device for piecing the yarn end drawn from the feed package and the yarn end drawn from the winding package.

4. The device of claim 3, further comprising a cylinder and a piston rod provided on the robot, wherein the yarn hook portion is provided on the piston rod and wherein the yarn hook portion comprises:

a horizontal hook surface secured to the piston rod, a roller provided on the horizontal hook surface, a first projection positioned forward of the roller, and a second projection positioned between the first projection and the piston rod, the first projection and the second projection being configured to hook therebetween a yarn end drawn out of a feed package by the operating arm, and the second projection and the piston rod being configured to hook therebetween a yarn end drawn out of a winding package by the suction arm when the hook portion moves upward.

5. The device of claim 4, wherein the hook portion defines a rear end and further comprising:

a yarn guide lever rockably supported at the rear of the hook portion, the yarn guide lever defining an extreme end, and a roller located at the extreme end of the yarn guide lever for hooking a middle portion of a yarn end between the hook portion and the operating arm for moving the yarn away from the hook portion.

6. The device of claim 2, wherein at least one of the units has a feed package having a top cap defining an upper end and a ball mounted on the upper end of the top cap, and further comprising:

a ball retaining portion provided on the operating arm for holding the ball during threading.

7. The device of claim 6, wherein the ball defines an upper surface having a spherical convex shape and wherein the ball retaining portion defines a spherical concave portion corresponding to the upper surface of the ball.

8. The device of claim 7, wherein the ball retaining portion comprises an elastic member.

9. The device of claim 7, further comprising:

means for producing negative pressure in the concave portion for attracting and holding the ball.

10. The device of claim 9, wherein the means for producing negative pressure comprises an air suction hole in the concave portion.

11. The device of claim 6, wherein the operating arm is provided with a magnet for mounting and removing, from a ball receiver, a steel ball for a tensor provided with a steel ball which is placed in a ball receiver formed at a top of a spindle and which applies tension to a yarn between ball receivers, the magnet having an N-pole and an S-pole vertically positioned with respect to a support member for vertical movement and forward and backward movement being fixed adjacent to each other so that the directions of poles are different from each other.

12. The device of claim 8, wherein the elastic member comprises rubber.

13. The device of claim 8, wherein the elastic member comprises synthetic resin.

* * * * *